US008539916B2

(12) United States Patent
Hamakawa et al.

(10) Patent No.: US 8,539,916 B2
(45) Date of Patent: Sep. 24, 2013

(54) COOLING STRUCTURE FOR INTERNAL COMBUSTION ENGINE

(75) Inventors: Takeru Hamakawa, Wako (JP); Shigeo Okui, Wako (JP); Naoto Kodama, Wako (JP); Atsushi Nakajima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 337 days.

(21) Appl. No.: 12/940,759

(22) Filed: Nov. 5, 2010

(65) Prior Publication Data

US 2011/0114043 A1 May 19, 2011

(30) Foreign Application Priority Data

Nov. 19, 2009 (JP) ..... 2009-264147

(51) Int. Cl.
*F02F 1/10* (2006.01)

(52) U.S. Cl.
USPC ..... 123/41.72; 123/41.84

(58) Field of Classification Search
USPC ..... 123/41.67, 41.72, 41.81, 41.79
See application file for complete search history.

(56) References Cited

U.S. PATENT DOCUMENTS

| | | | | |
|---|---|---|---|---|
| 7,438,026 | B2 * | 10/2008 | Nakada et al. | 123/41.74 |
| 2003/0230254 | A1 * | 12/2003 | Matsutani et al. | 123/41.79 |
| 2005/0028758 | A1 * | 2/2005 | Hughes et al. | 123/41.74 |
| 2005/0217614 | A1 * | 10/2005 | Matsutani et al. | 123/41.74 |
| 2008/0060593 | A1 | 3/2008 | Nakada et al. | |

FOREIGN PATENT DOCUMENTS

| | | | |
|---|---|---|---|
| JP | 60-164645 | U | 11/1985 |
| JP | 2002-13440 | A | 1/2002 |
| JP | 3596438 | B2 | 12/2004 |
| JP | 2008-64054 | A | 3/2008 |
| JP | 2008-208744 | A | 9/2008 |
| JP | 2009-243414 | A | 10/2009 |
| JP | 2009-257104 | A | 11/2009 |
| JP | 2009-287428 | A | 12/2009 |

* cited by examiner

*Primary Examiner* — Thanh K Truong
*Assistant Examiner* — Syed O Hasan
(74) *Attorney, Agent, or Firm* — Arent Fox LLP

(57) ABSTRACT

A height of a spacer which is arranged inside a water jacket formed to surround peripheries of cylinder bores of a cylinder block of an internal combustion engine is made to be lower by a step in an intermediate portion thereof in a cylinder row line direction. Consequently, among end-portion cylinder bores having a lower temperature and being situated at opposite end portions in the cylinder row line direction and intermediate cylinder bores being other than the end-portion cylinder bores and having a higher temperature, a cooling performance of the intermediate cylinder bores is higher than that of the end-portion cylinder bores. Therefore, all the temperatures of the respective cylinder bores can be made uniform. A similar operation effect can be obtained alternatively by making a thickness of the spacer thinner in portions facing the intermediate cylinder bores and thicker in portions facing the end-portion cylinder bores.

6 Claims, 15 Drawing Sheets

COOLING STRUCTURE FOR INTERNAL COMBUSTION ENGINE

BACKGROUND OF THE INVENTION

1. Field of the Invention

The present invention relates to a cooling structure for an internal combustion engine in which: a spacer is fitted inside a water jacket which is formed to surround peripheries of three or more cylinder bores arranged one after another on a cylinder row line of a cylinder block of the internal combustion engine; and a cooling condition of the cylinder bores is controlled by regulating a flow of cooling water in the water jacket by use of the spacer.

2. Description of the Related Art

Japanese Patent No. 3596438 has made publicly known such a cooling structure for an internal combustion engine in which: the heat transfer coefficient of the spacer fitted inside the water jacket is made different between the thrust/reverse-thrust sides of the cylinder bores (portions distant from the cylinder row line) and the inter-bore portions of the cylinder bores (portions close to the cylinder row line); and thereby, the cylinder bores are uniformly cooled throughout their whole peripheries.

Meanwhile, in a cylinder block in which three or more cylinder bores are arranged one after another along the cylinder row line, each of the two cylinder bores (end-portion cylinder bores) in the respective two end portions in the cylinder row line direction has only one adjacent cylinder bore. For this reason, each end-portion cylinder bore receives a smaller quantity of heat from its adjacent cylinder bore, and reaches a lower temperature. On the other hand, since each of the cylinder bores (intermediate cylinder bores) other than the end-portion cylinder bores has two adjacent cylinder bores, the intermediate cylinder bore receives a larger quantity of heat from the adjacent cylinder bores and reaches a higher temperature.

As described above, the temperature difference occurs between the end-portion cylinder bores and the intermediate cylinder bores. Even though the end-portion cylinder bores and the intermediate cylinder bores are thermally insulated equally by the spacer, all the temperatures of the cylinder bores cannot be made uniform. This leads to a problem that variations occur among the clearances between the pistons and the corresponding cylinder bores.

SUMMARY OF THE INVENTION

The present invention has been made in view of the foregoing situation. An object of the present invention is to make uniform the temperatures of multiple cylinder bores arranged in a cylinder row line direction by use of a spacer placed inside a water jacket.

In order to achieve the object, according to a first feature of the present invention, there is provided a cooling structure for an internal combustion engine in which: a spacer is fitted inside a water jacket which is formed to surround peripheries of three or more cylinder bores arranged one after another on a cylinder row line of a cylinder block of the internal combustion engine; and a cooling condition of the cylinder bores is controlled by regulating a flow of cooling water in the water jacket by use of the spacer, wherein the cylinder bores comprise end-portion cylinder bores situated respectively in opposite end portions in a direction of the cylinder row line, and one or more intermediate cylinder bores other than the end-portion cylinder bores, and the spacer is configured so that cooling performances for the intermediate cylinder bores are higher than those for the end-portion cylinder bores.

According to the first feature of the present invention, the spacer is fitted inside the water jacket which is formed to surround the peripheries of the cylinder bores in the cylinder block of the internal combustion engine. For this reason, the cylinder bores are thermally insulated by regulating the flow of the cooling water in the water jacket by use of the spacer. Thereby, the friction between the cylinder bores and the corresponding pistons can be reduced by thermally expanding the cylinder bores. The spacer is configured in such a way that the cooling performances of intermediate cylinder bores are higher than the cooling performances of end-portion cylinder bores, the intermediate cylinder bores being other than the end-portion cylinder bores, and having the higher temperature; and the end-portion cylinder bores being situated in the respective opposite end portions in the cylinder row line direction, and having the lower temperature. For this reason, the effect of cooling the intermediate cylinder bores whose temperatures become higher can be enhanced, and all the temperatures of the respective cylinder bores can be made uniform.

According to a second feature of the present invention, in addition to the first feature, the spacer comprises a spacer main body part defining an upper cooling water passage for an upper side and a lower cooling water passage for a lower side inside the water jacket, and the spacer main body part has a less height in an up-and-down-direction in portions facing the intermediate cylinder bores than in portions facing the end-portion cylinder bores.

According to the second feature of the present invention, the spacer includes the spacer main body part for defining the upper cooling water passage for the upper side and the lower cooling water passage for the lower side inside the water jacket. In addition, the height in the up-and-down-direction of the spacer main body part is less in its portions facing the intermediate cylinder bores than in its portions facing the end-portion cylinder bores. For this reason, the upper cooling water passage and the lower water passage are made to face the intermediate cylinder bores, whose temperatures become higher than those of the end-portion cylinder bores, with their wider areas. Thereby, the effect of cooling the intermediate cylinder bores can be enhanced, and all the temperatures of the respective cylinder bores can be made uniform.

According to a third feature of the present invention, in addition to the first feature, the spacer comprises a spacer main body part for regulating the flow of the cooling water in the water jacket, and the spacer main body part has a smaller thickness in a radial direction in portions facing the intermediate cylinder bores than in portions facing the end-portion cylinder bores.

According to the third feature of the present invention, the thickness in the radial direction of the spacer main body part for regulating the flow of the cooling water inside the water jacket is less in its portions facing the intermediate cylinder bores than in its portions facing the end-portion cylinder bores. For this reason, the thinner portions of the spacer main body part are made to face the intermediate cylinder bores whose temperatures become higher than those of the end-portion cylinder bores, and the dissipation of heat from the intermediate cylinder bores to the cooling water is facilitated. Thereby, the effect of cooling the intermediate cylinder bores can be enhanced, and all the temperatures of the respective cylinder bores can be made uniform.

According to a fourth feature of the present invention, in addition to the first feature, the spacer comprises a spacer main body part for regulating the flow of the cooling water in the water jacket, and a passage of the cooling water between an inner peripheral surface of the spacer main body part and an inner wall surface of the water jacket has a larger cross-sectional area in portions facing the intermediate cylinder bores than in portions facing the end-portion cylinder bores.

According to the fourth feature of the present invention, the cross-sectional area of the passage of the cooling water, which is interposed between the inner peripheral surface of the spacer main body part for regulating the flow of the cooling water in the water jacket and the inner wall surface of the water jacket, is larger in its portions facing the intermediate cylinder bores than in its portions facing the end-portion cylinder bores. For this reason, the effect of cooling the intermediate cylinder bores whose temperatures become higher than those of the end-portion cylinder bores can be enhanced, and all the temperatures of the respective cylinder bores can be made uniform.

According to a fifth feature of the present invention, in addition to the fourth feature, biasing means for biasing the opposite end portions of the spacer main body part in the cylinder row line direction toward the inner wall surface of the water jacket are provided between the opposite end portions of the spacer main body part in the cylinder row line direction and an outer wall surface of the water jacket.

According to the fifth feature of the present invention, the opposite end portions of the spacer main body part are biased toward the inner wall surface of the water jacket by the biasing means provided between the opposite end portions of the spacer main body part in the cylinder row line direction and the outer wall surface of the water jacket. For this reason, the intake-side and exhaust-side side surfaces of the spacer can be made to deform toward the outer wall surface of the water jacket, and the cross-sectional area of the passage of the cooling water which is interposed between the inner peripheral surface of the spacer main body part and the inner wall surface of the water jacket can be made larger in the spacer main body part's portions facing the intermediate cylinder bores than in its portions facing the end-portion cylinder bores.

According to a sixth feature of the present invention, in addition to the fifth feature, the biasing means are fixing members for fixing the spacer inside the water jacket.

According to the sixth feature of the present invention, the fixing members for fixing the spacer to the inside of the water jacket are used as the biasing means. For this reason, the number of parts can be made smaller than the number of parts which are needed in a case where specialized biasing means are provided thereto.

Here, note that an end-portion cylinder bore 12*a* and an intermediate cylinder bore 12*a*' of embodiments correspond to the cylinder bores of the present invention; and a fixing member 22' of the embodiments correspond to the biasing means of the present invention.

The above description, other objects, characteristics and advantages of the present invention will be clear from detailed descriptions which will be provided for the preferred embodiments referring to the attached drawings.

BRIEF DESCRIPTION OF THE DRAWINGS

Descriptions will be hereinbelow provided for a first embodiment of the present invention on the basis of FIGS. 1 to 12.

Figure 1:
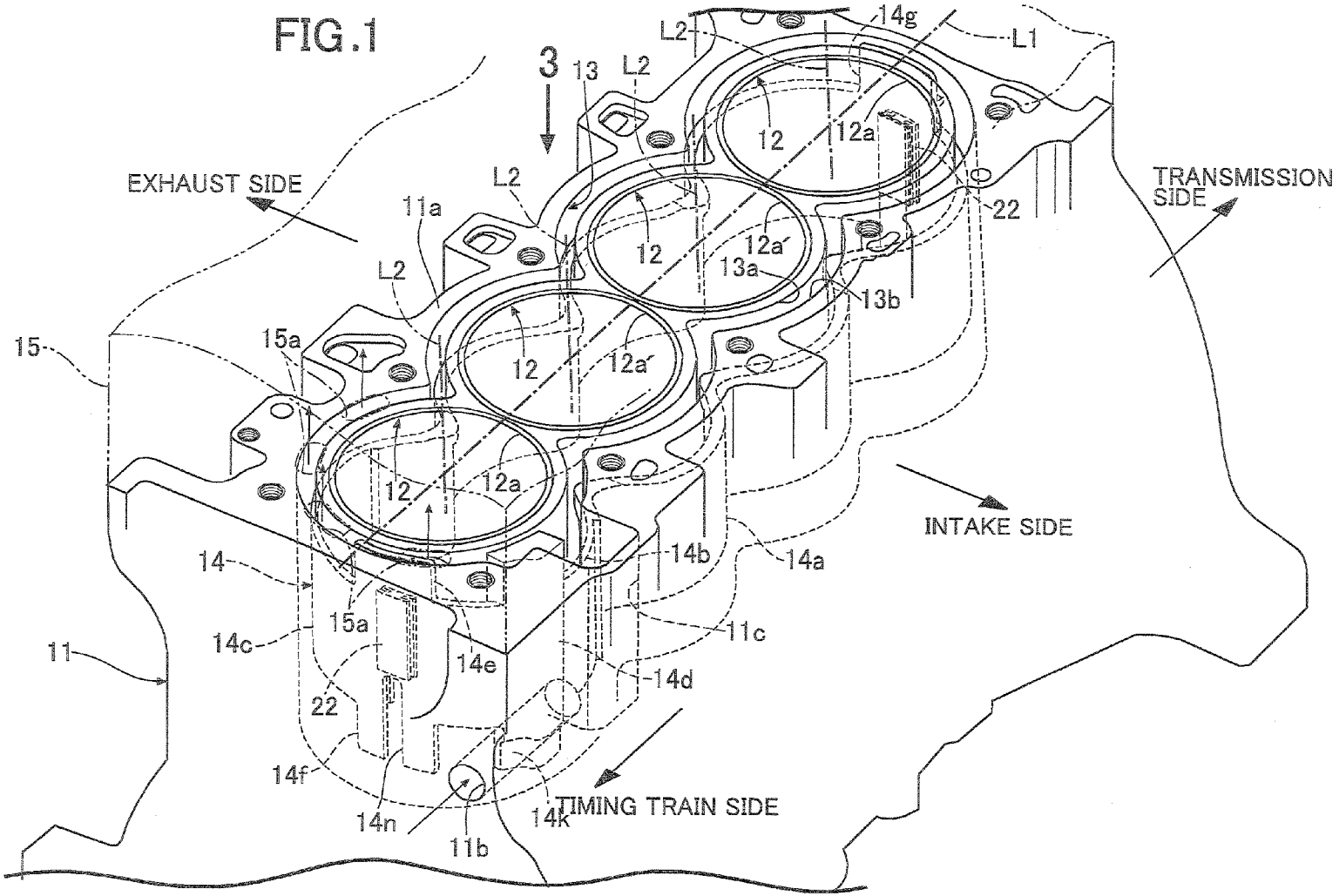
FIG. 1 is a perspective view of a cylinder block of an internal combustion engine with four cylinders mounted in a straight line (First embodiment)

As shown in FIG. 1, four cylinder sleeves 12 are embedded along a cylinder row line L1 in a cylinder block 11 of an internal combustion engine with four cylinders mounted in a straight line. A water jacket 13 is formed to surround the outer peripheral surfaces of the respective cylinder sleeves 12. The cylinder block 11 according to this embodiment is of a Siamese type, and no portion of the water jacket 13 is formed between each neighboring two of the cylinder sleeves 12. Thereby, the shortening of the dimension of the internal combustion engine in the cylinder row line L1 direction is achieved. The water jacket 13 opened in a deck surface 11*a* of the cylinder block 11 extends downward from the deck surface 11*a* toward a crankcase up to a certain depth. A spacer 14 made of a synthetic resin is arranged in an interstice between an inner wall surface 13*a* and an outer wall surface 13*b* of the water jacket 13. The spacer 14 is inserted in the interstice therebetween from the opening in the deck surface 11*a* of the cylinder block 11.

Note that with regard to an "up-and-down direction" in this description, the cylinder head side in a cylinder axis line L2 direction is defined as "upper," and the crankcase side in the cylinder axis line L2 direction is defined as "lower."

As clear from FIGS. 1 to 5, the spacer 14 includes a spacer main body part 14*a*, a cooling water inlet port part 14*b* and a cooling water outlet port part 14*c*. The entire peripheries of four cylinder bores 12*a*, 12*a*'; 12*a*', 12*a*' in the cylinder bock 11 are surrounded by the spacer main body part 14*a*, the cooling water inlet port part 14*b* and the cooling water outlet port part 14*c*. The cooling water inlet port part 14*b* surrounds an intake-side portion of one cylinder bore 12*a* which is situated on a first end side in the cylinder row line L1 direction (on a timing train side). The cooling water outlet port part 14*c* surround the first end-side portion of the cylinder bore 12*a* in the cylinder row line L1 direction and an exhaust side-portion of the cylinder bore 12*a*. A partition wall 14*d* is integrally provided in a position which is slightly offset from the first end-side portion of the spacer 14 in the cylinder row line L1 direction to the intake-side portion of the space 14, and which intervenes between the cooling water inlet port part 14*b* and the cooling water outlet port part 14*c*. The partition wall 14*d* is formed thicker than the spacer main body part 14*a*, and projects upward from the upper edges of the cooling water inlet port part 14*h* and the cooling water outlet port part 14*c*, and downward from the lower edges of the cooling water inlet port part 14*b* and the cooling water outlet port part 14*c*.

Inside the water jacket 13, an upper cooling water passage 13*c* surrounding the peripheries of the respective four cylinder bores 12*a*, 12*a*; 12*a*', 12*a*' is formed between the upper edge of the spacer main body part 14*a* and an undersurface of a cylinder head 15. In addition, a lower cooling water passage 13*d* surrounding the peripheries of the respective four cylinder bores 12*a*, 12*a*; 12*a*', 12*a*' is formed between the lower edge of the spacer main body part 14*a* and the bottom portion of the water jacket 13.

An upper support leg 14*e* and a lower support leg 14*f* project to the insides of the upper cooling water passage 13*c* and the lower cooling water passage 13*d*, respectively, from a position at which the cylinder row line L1 intersects the cooling water outlet port part 14*c* on its first end side. In addition, an upper support leg 14*g* and a lower support leg 14*h* project to the insides of the upper cooling water passage 13*c* and the lower cooling water passage 13*d*, respectively, from a position at which the cylinder row line L1 intersects the spacer main body part 14*a* on its second end side (on the side closer to a transmission). For this reason, when the spacer 14 is attached to the inside of the water jacket 13, the lower ends of the respective paired lower support legs 14*f*, 14*h* are in contact with the bottom portion of the water jacket 13, and the upper ends of the respective paired upper support legs 14*e*, 14*g* are in contact with the undersurface of a gasket 16 held between the cylinder block 11 and the cylinder head 15, in the opposite end portions in the cylinder row line L1 direction. Thereby, the spacer 14 is positioned in the up-and-down direction.

Pistons 18, 18; 18', 18' (refer to FIG. 3) connected to a crankshaft 17 are slidably fitted in the respective cylinder bores 12*a*, 12*a*; 12*a*', 12*a*'. Top rings 19, second rings 20 and oil rings 21 are attached to top parts 18*a* of the pistons 18, 18; 18*a*', 18*a*', respectively.

Descriptions will be hereinbelow provided for the detailed structure of the spacer 14 sequentially.

Figure 2:
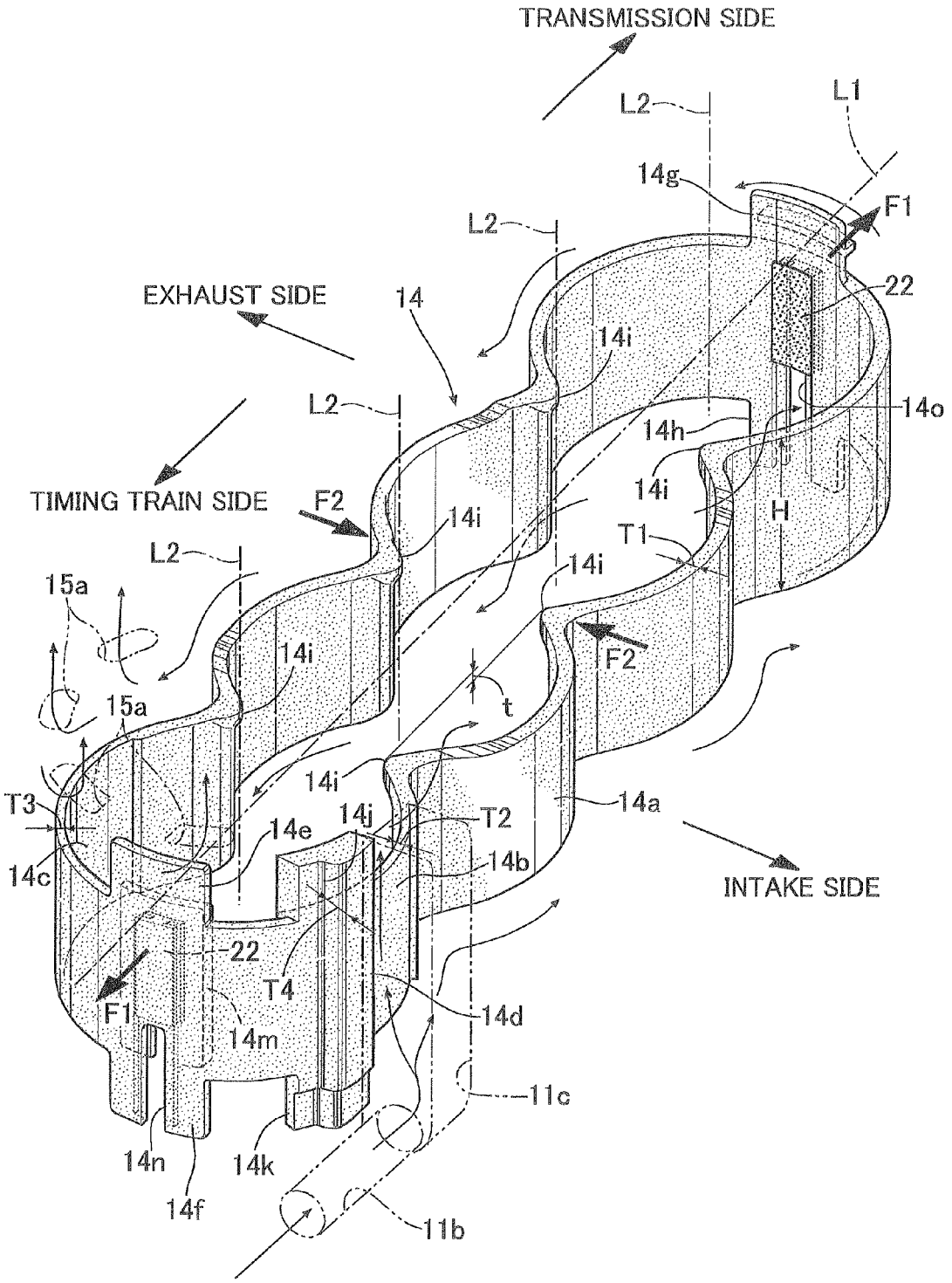
FIG. 2 is a perspective view of a spacer (First embodiment)
Figure 3:
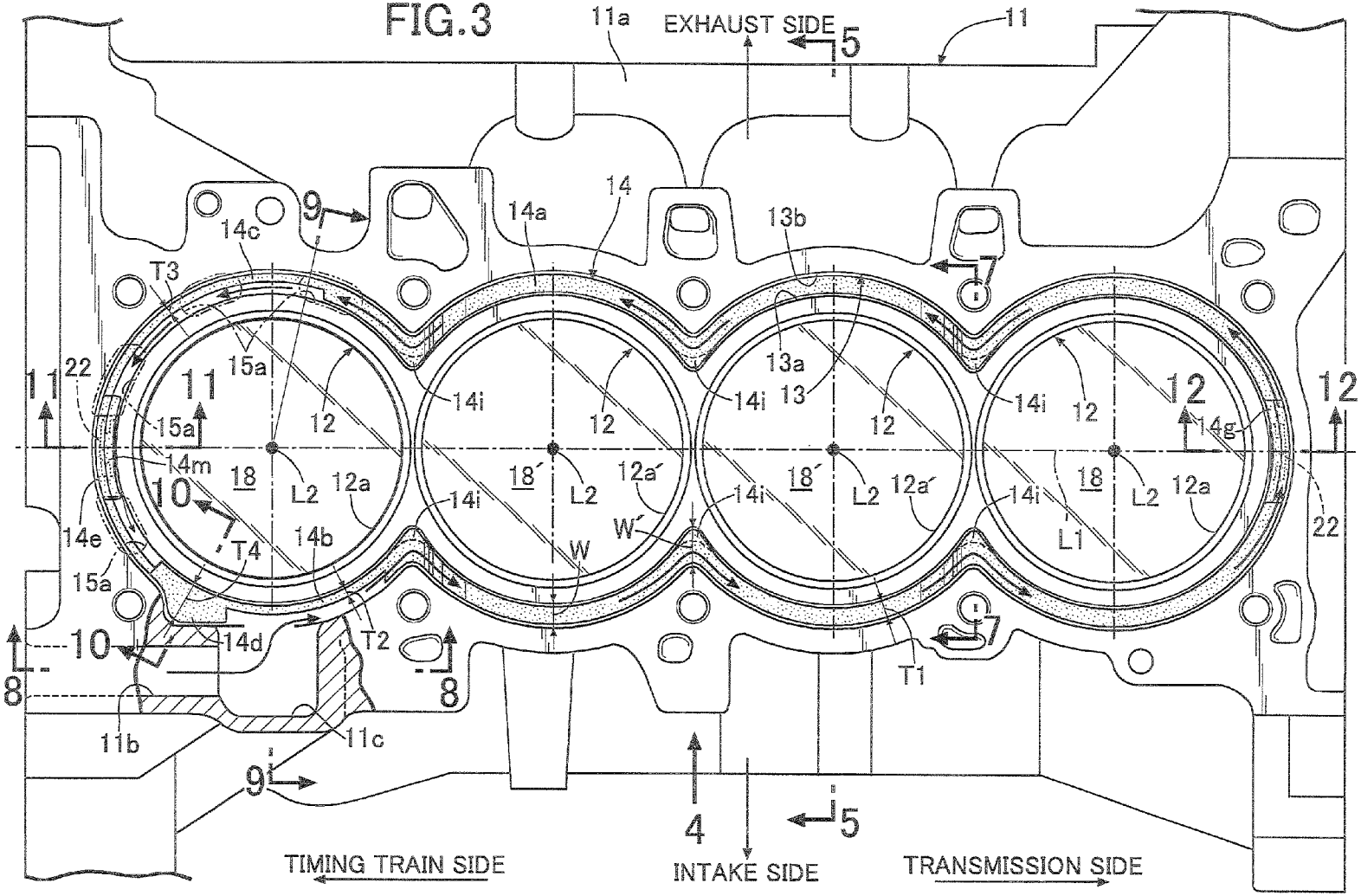
FIG. 3 is a view seen from a direction of an arrow 3 in FIG. 1 (First embodiment)
Figure 4:
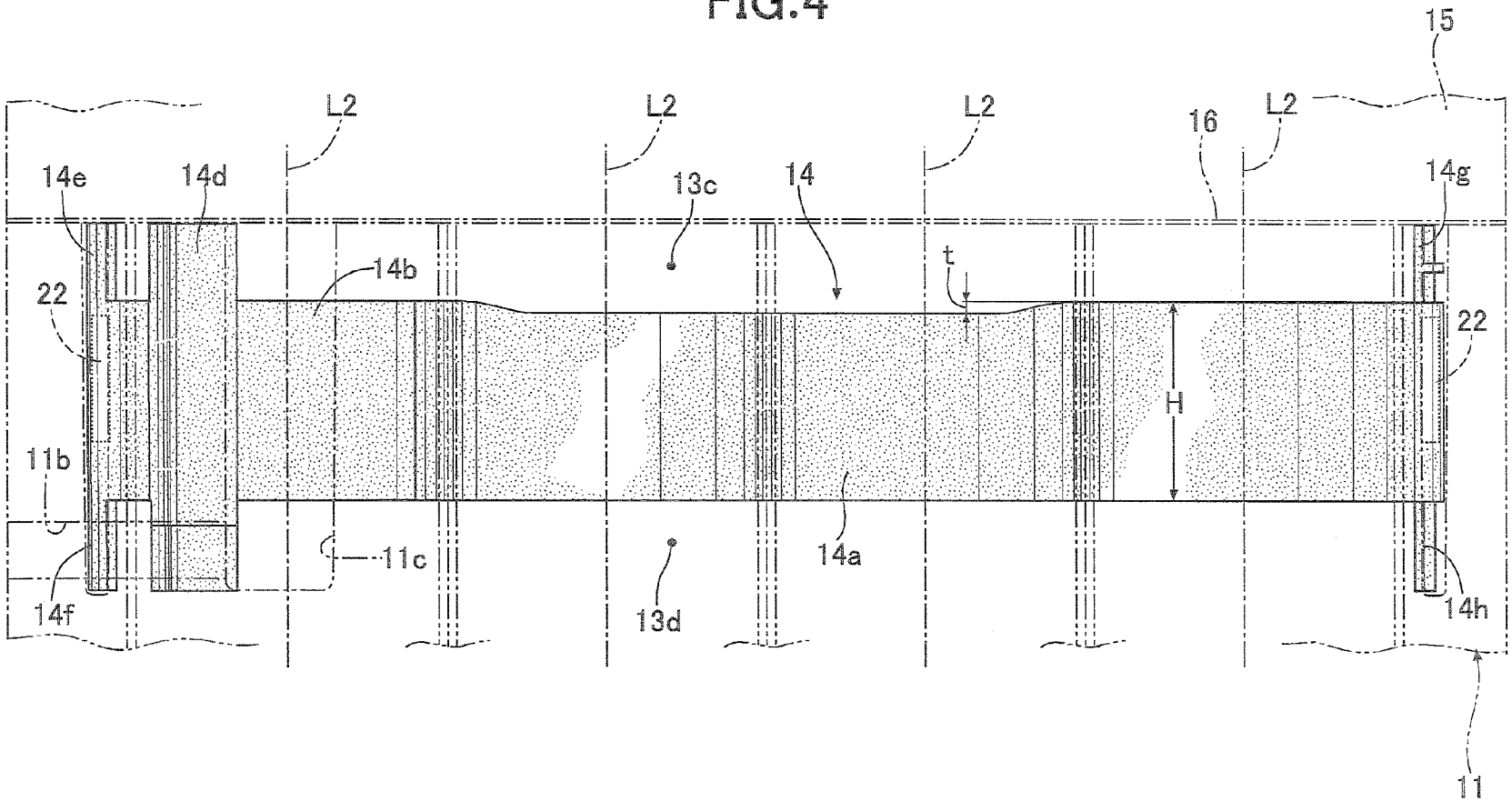
FIG. 4 is a view seen from a direction of an arrow 4 in FIG. 3 (First embodiment)

As clear from FIGS. 2 to 4, the heights H of the spacer main body part 14*a*, the cooling water inlet port part 14*b* and the cooling water outlet port part 14*c* of the spacer 14 in a cylinder axis line L2 direction are not uniform. Portions of the spacer 14 which face the end-portion cylinder bores 12*a*, 12*a* in the opposite end portions in the cylinder row line L1 direction are higher in height H, and portions of the spacer 14 which face the intermediate cylinder bores 12*a*', 12*a*' in the intermediate portion in the cylinder row line L1 direction are lower in height H by a step t.

As clear from FIGS. 2 and 3, the thickness T1 of the spacer main body part 14*a* is basically constant. However, the thickness T2 of the cooling water inlet port part 14*b* is thinner than the thickness T1 of the spacer main body part 14*a*, and the thickness T3 of the cooling water outlet port part 14*c* is thinner than the thickness T1 of the spacer main body part 14*a*. In addition, the thickness T4 of the partition wall 14*d* is thicker than the thickness T1 of the spacer main body part 14*a*. The inner peripheral surface of the cooling water inlet port part 14*b* is flush with the inner peripheral surface of the spacer main body part 14*a*. The outer peripheral surface of the cooling water inlet port part 14*b* is offset inward in a radial direction from the outer peripheral surface of the spacer main body part 14*a* by a step. Furthermore, the outer peripheral surface of the cooling water outlet port part 14*c* is flush with the outer peripheral surface of the spacer main body part 14*a*. The inner peripheral surface of the cooling water outlet port part 14*c* is offset outward in the radial direction from the inner peripheral surface of the spacer main body part 14*a* by a step.

Figure 5:
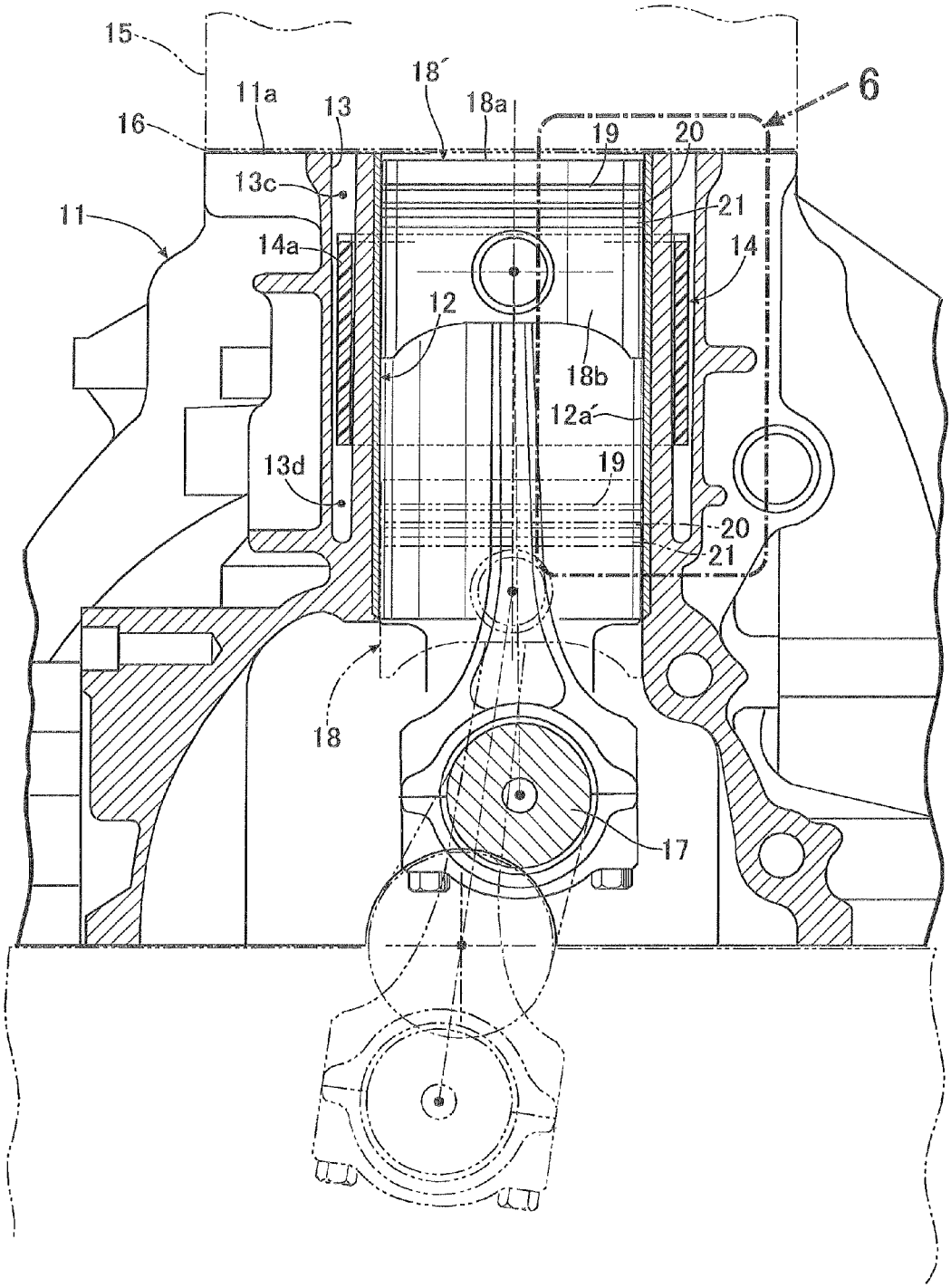
FIG. 5 is a sectional view taken along a line 5-5 in FIG. 3 (First embodiment)

As clear from FIG. 5, while the pistons 18, 18; 18', 18' are moving in the respective cylinder bores 12*a*, 12*a*; 12*a*', 12*a*' up and down in response to rotation of the crankshaft 17, side thrusts acting between the pistons 18, 18; 18', 18' and the cylinder bores 12*a*, 12*a*; 12*a*', 12*a*' change periodically. Each side thrust reaches a maximum when the corresponding one of the pistons 18, 18; 18', 18' reaches a position of the expansion stroke which is indicated by the continuous line (for example, a position where the crank angle is at 15° after the compression top dead center). The up-and-down position of the spacer 14 inside the water jacket 13 is set in such a way that the top ring 19, the second ring 20 and the oil ring 21 of each of the pistons 18, 18; 18', 18' are located above the upper edge of the spacer 14, and a skirt part 18*b* of the piston 18, 18; 18', 18' is located below the upper edge of the spacer 14 when the piston 18, 18; 18', 18' is located at the position maximizing the side thrust. Furthermore, the up-and-down position of the spacer 14 inside the water jacket 13 is set in such a way that the top ring 19, the second ring 20 and the oil ring 21 of each of the pistons 18, 18; 18', 18' are located below the lower edge of the spacer 14 when the piston 18, 18; 18', 18' is located at the bottom dead center position indicated by the chain line.

Figure 6:
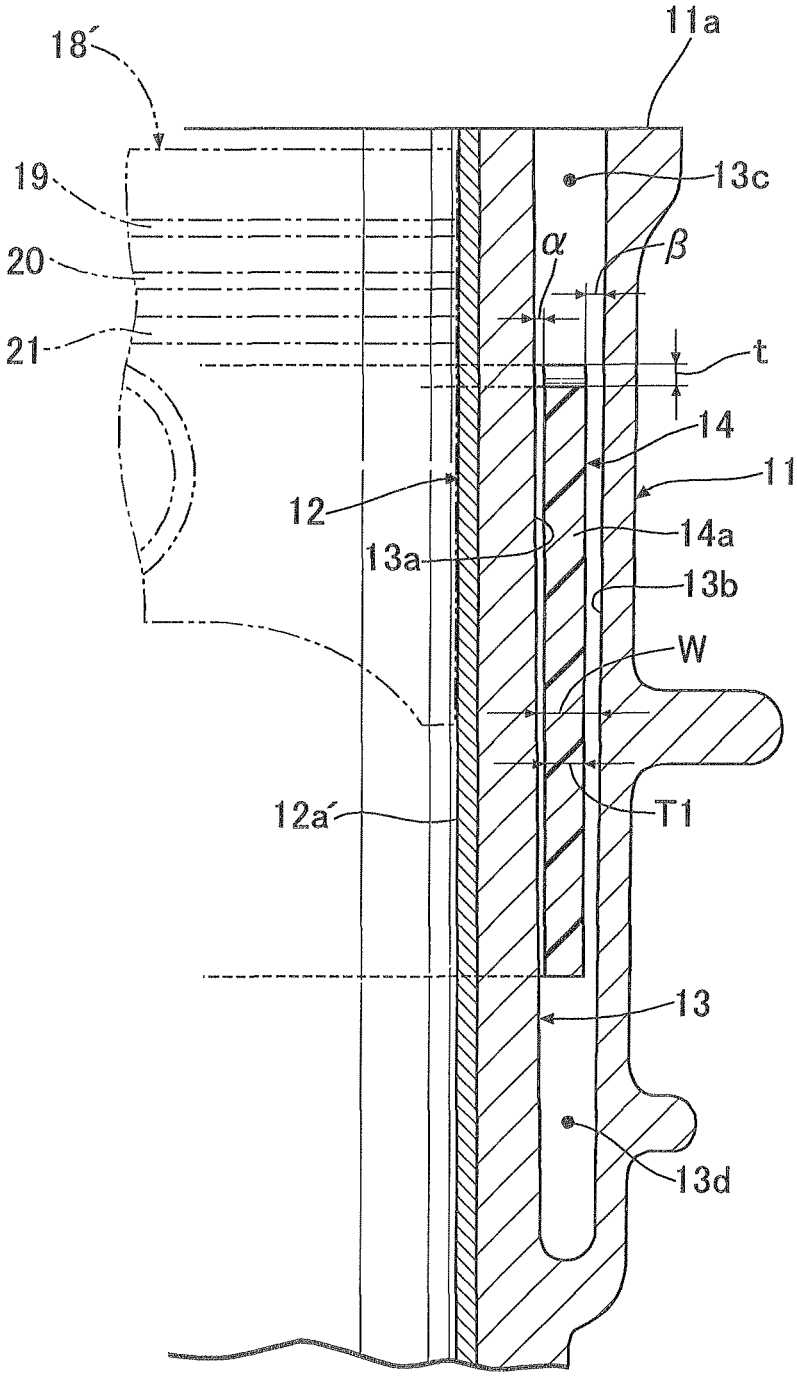
FIG. 6 is an enlarged view of a part indicated by an arrow 6 in FIG. 5 (First embodiment)

As clear from FIG. 6, the thickness T1 of the spacer main body part 14*a* is set slightly less than the width W of the water jacket 13 in which the spacer main body part 14*a* is fitted. The reason for this is to prevent the assemblability from deteriorating due to friction of the spacer 14 with the inner wall surface 13*a* and the outer wall surface 13*b* of the water jacket 13 resulting from the fact that the dimensional precision of the inner wall surface 13*a* and the outer wall surface 13*b* of the water jacket 13, which have been subjected to no process since casted, is not high. Accordingly, when the spacer 14 is assembled inside the water jacket 13, a space $\alpha$ is formed between the inner peripheral surface of the spacer main body part 14*a* and the inner wall surface 13*a* of the water jacket 13, and a space $\beta$ is formed between the outer peripheral surface of the spacer main body part 14*a* and the outer wall surface 13*b* of the water jacket 13. The spacer main body part 14*a* is arranged therein in such a way that the space $\alpha$ is set smaller than the space $\beta$, that is to say, the spacer main body part 14*a* is closer to the inner wall surface 13*a* of the water jacket 13 than to the outer wall surface 13*b* thereof.

Figure 7:
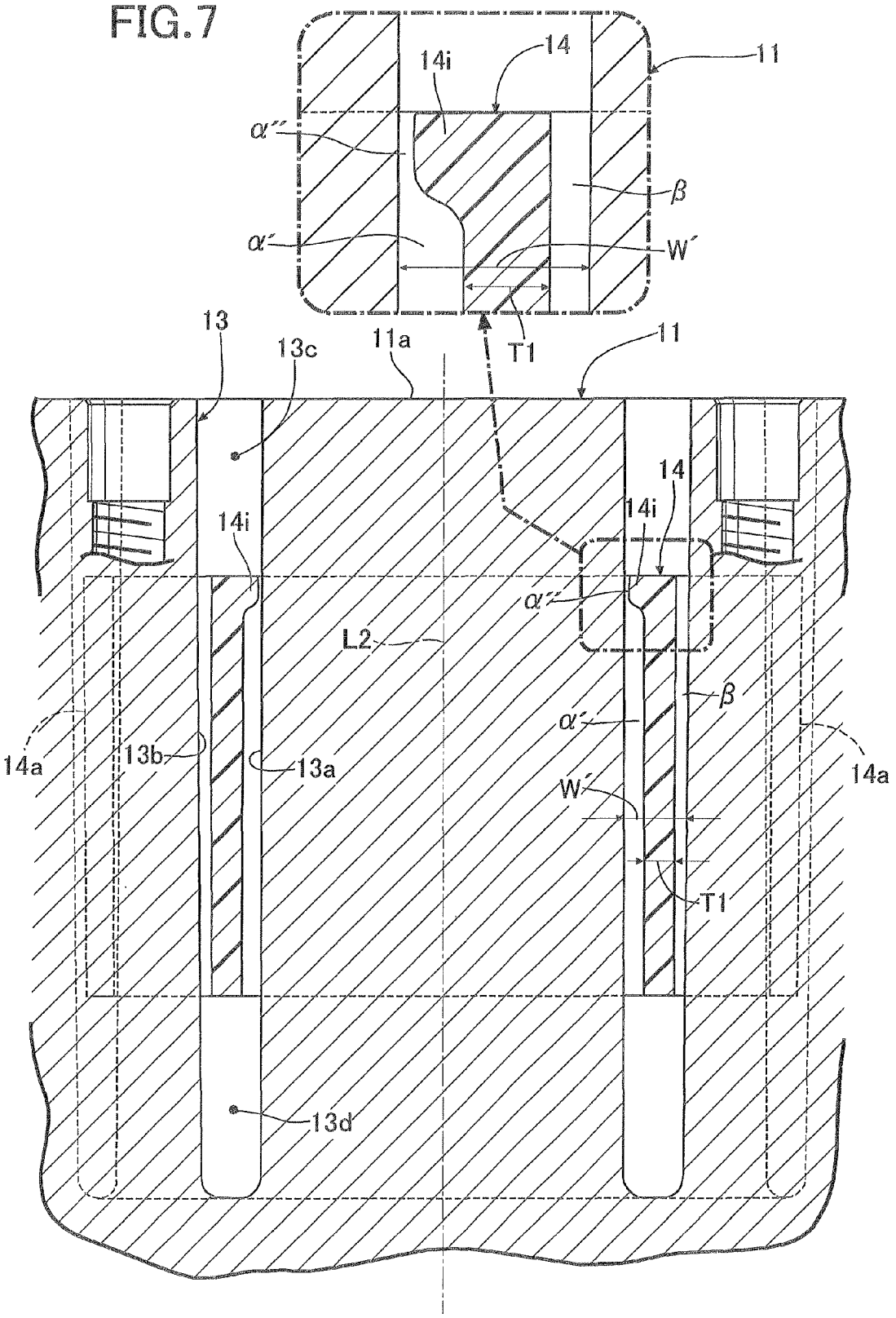
FIG. 7 is a sectional view taken along a line 7-7 in FIG. 3 (First embodiment)
Figure 8:
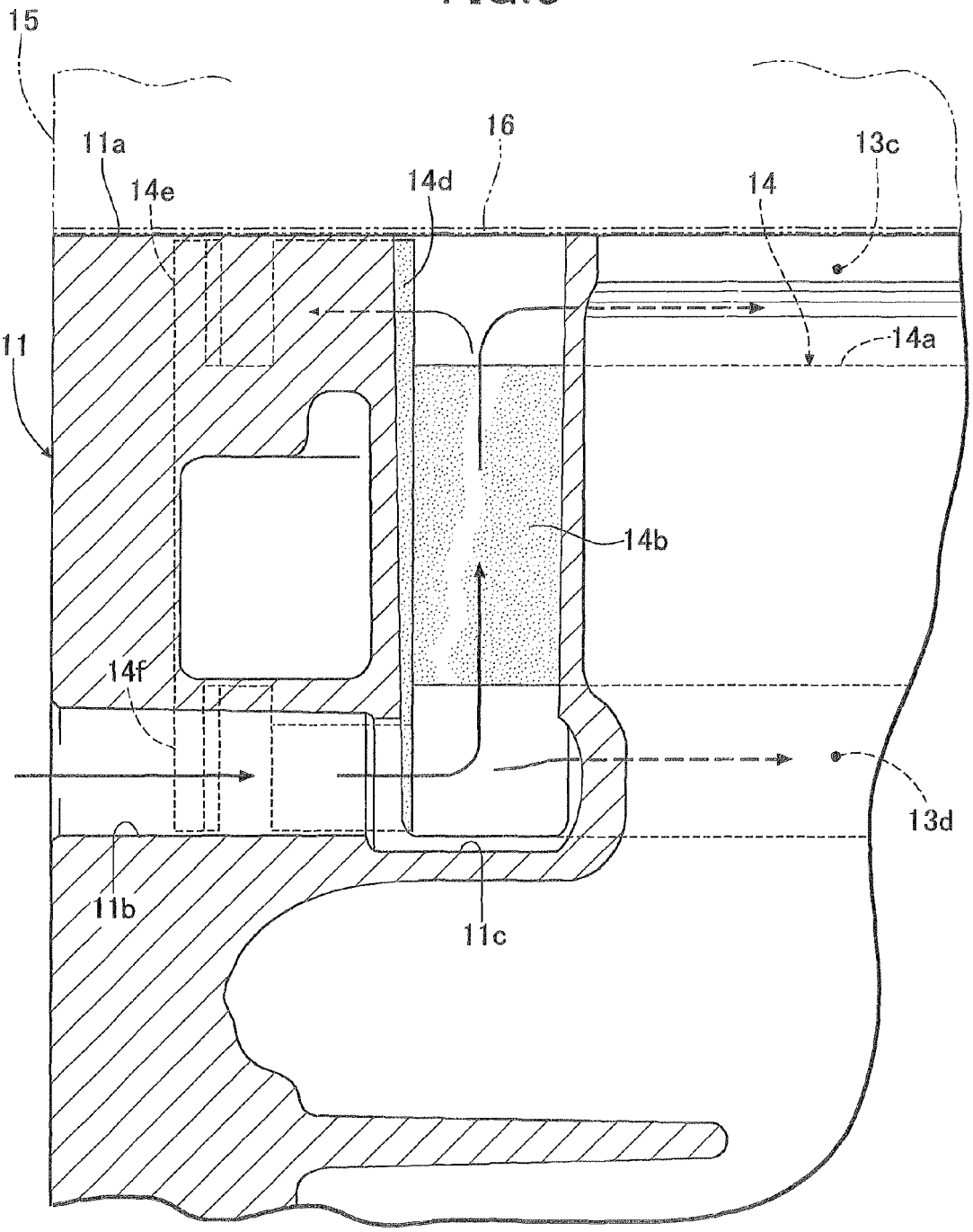
FIG. 8 is a sectional view taken along a line 8-8 in FIG. 3 (First embodiment)
Figure 9:
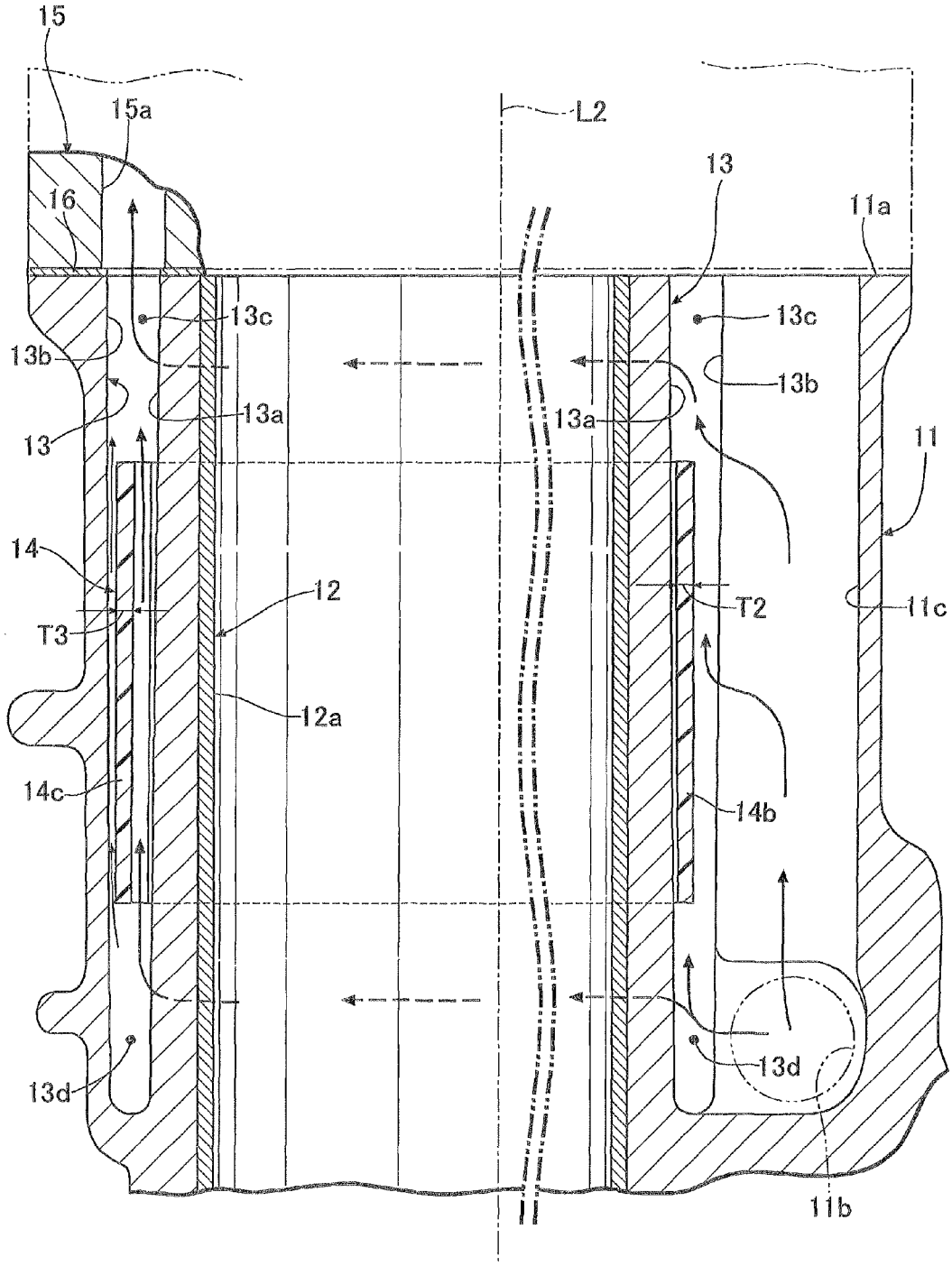
FIG. 9 is a sectional view taken along a line 9-9 in FIG. 3 (First embodiment)
Figure 10:
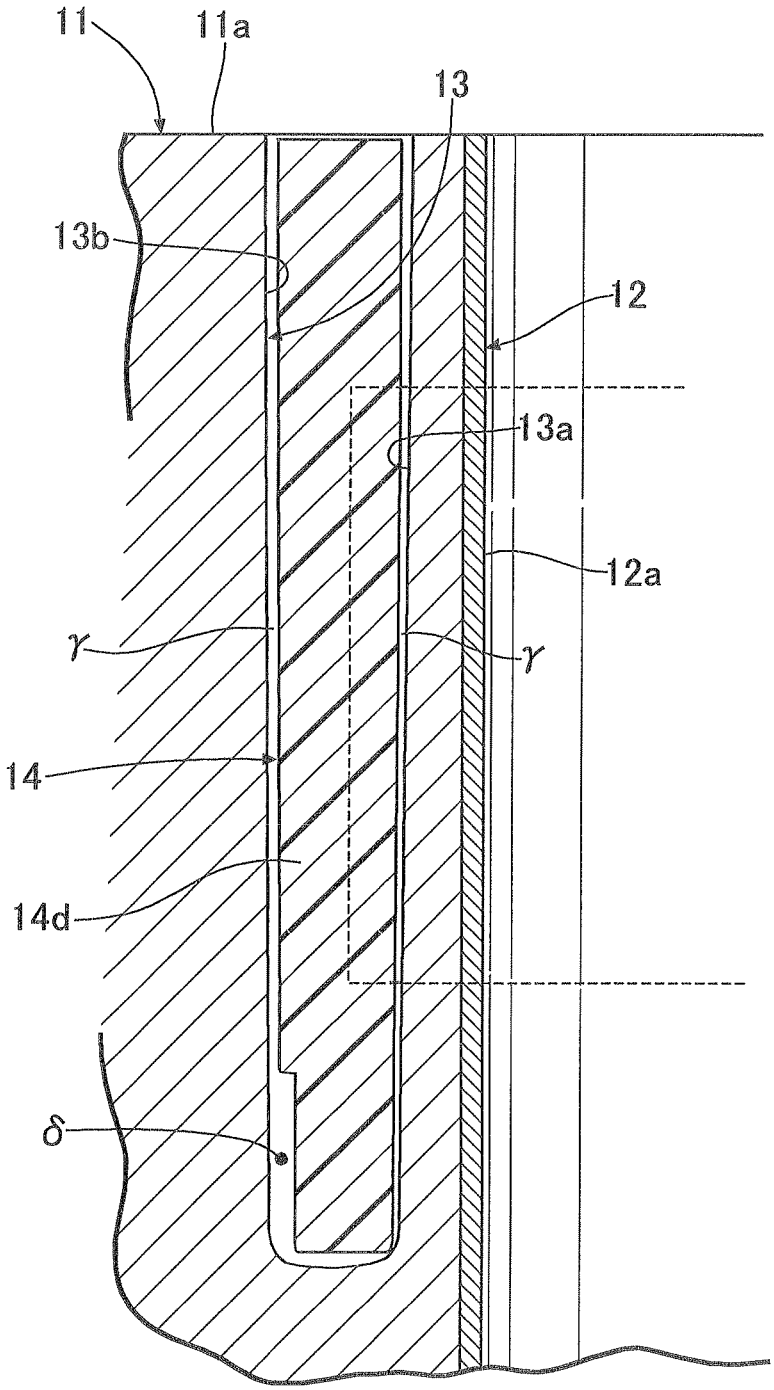
FIG. 10 is a sectional view taken along a line 10-10 in FIG. 3 (First embodiment)
Figure 11B:
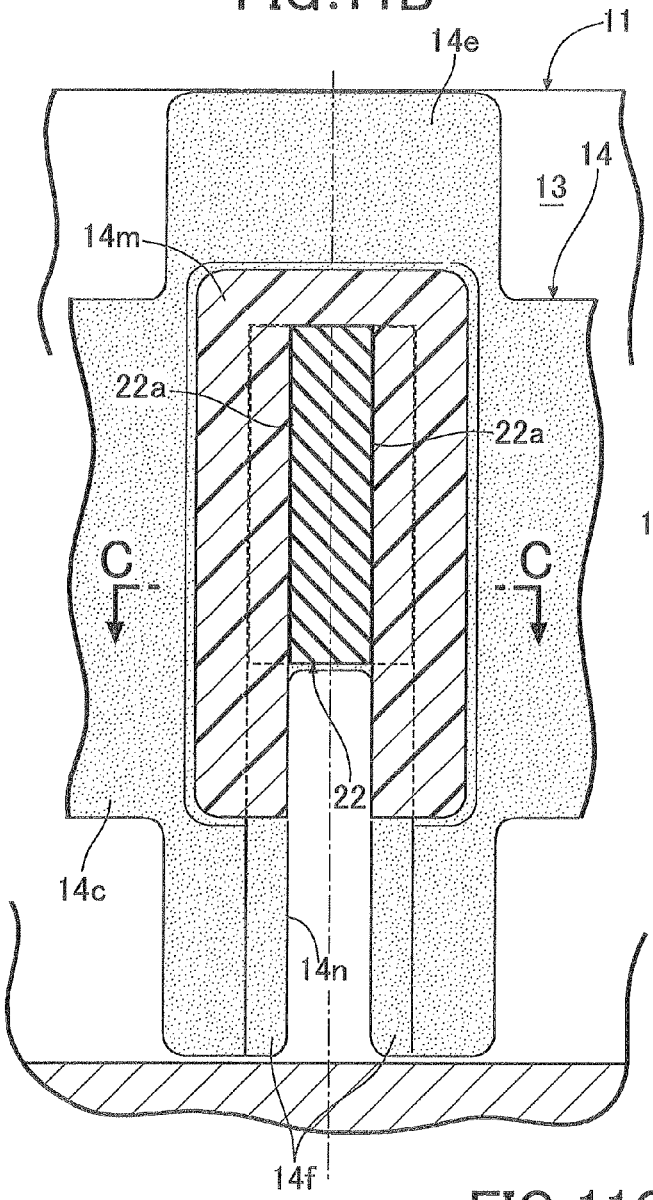
FIG. 11B is a sectional view taken along a line B-B in FIG. 11A (First embodiment)
Figure 11A:
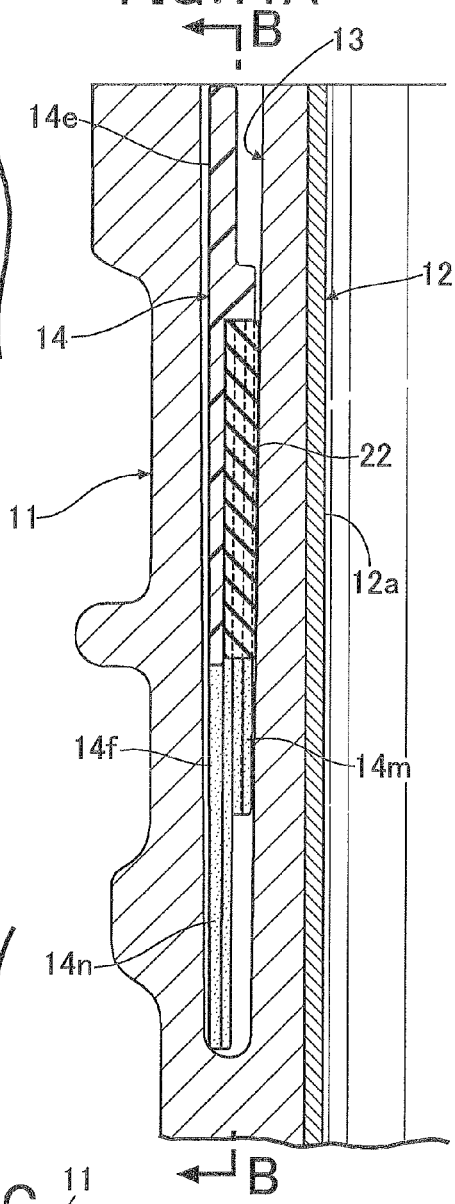
FIG. 11A is a sectional view taken along a line 11-11 in FIG. 3 (First embodiment)
Figure 11C:
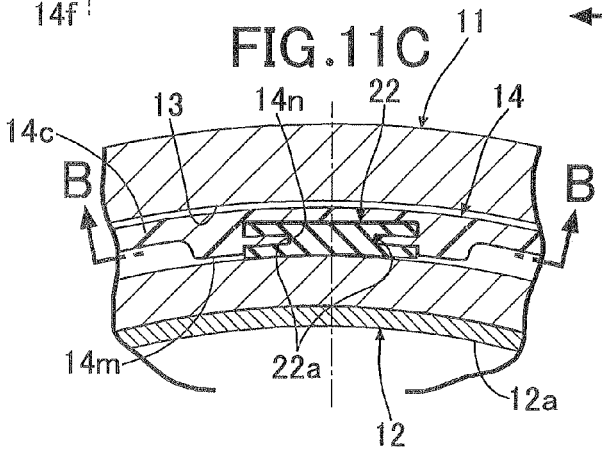
FIG. 11C is a sectional view taken along a line C-C in FIG. 11B (First embodiment)
Figure 12B:
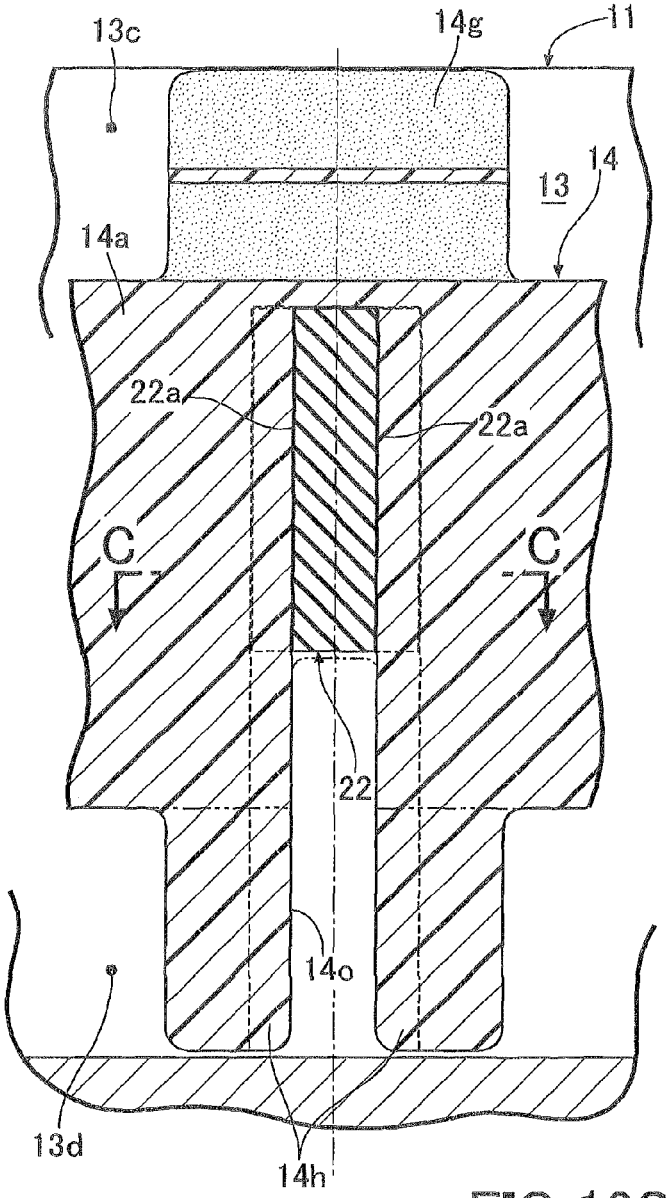
FIG. 12B is a sectional view taken along a line B-B in FIG. 12A (First embodiment)
Figure 12A:
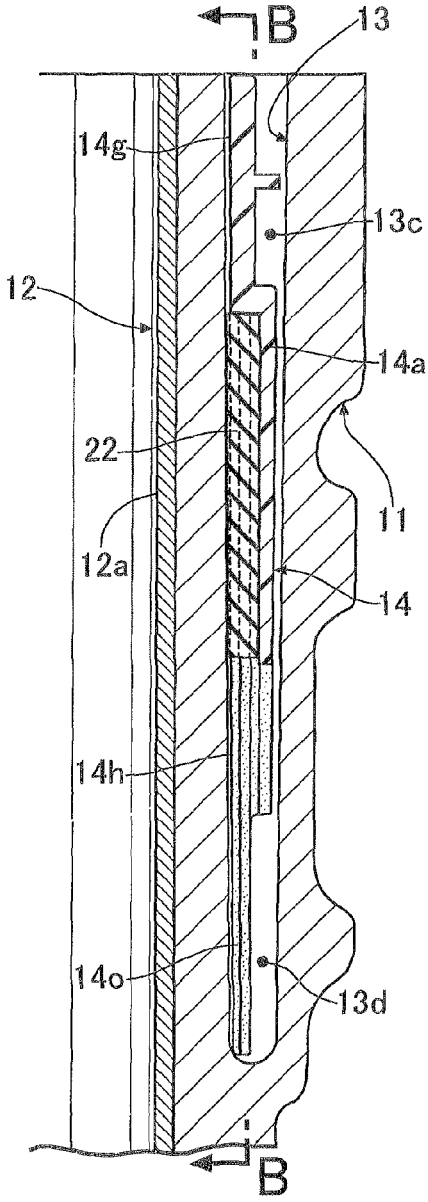
FIG. 12A is a sectional view taken along a line 12-12 in FIG. 3 (First embodiment)
Figure 12C:
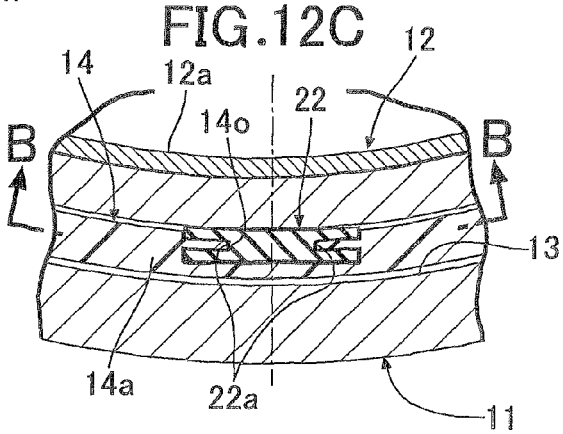
FIG. 12C is a sectional view taken along a line C-C in FIG. 12B (First embodiment)

As clear from FIGS. 3 and 7, portions of the water jacket 13 which respectively surround the corresponding two adjacent cylinder sleeves 12, 12 intersect at an acute angle in each inter-bore portion in the cylinder block 11, which is a position at which the corresponding two cylinder sleeves 12, 12 are close to each other. For this reason, a width W' of a portion of the water jacket 13 in a direction orthogonal to the cylinder row line L1 is wider than the width W of any other portion of the water jacket 13. On the other hand, a thickness of a portion of the spacer main body part 14*a* in each inter-bore portion is equal to T1 which is the thickness of any other portion of the spacer main body part 14*a*. For this reason, a space α' between the inner peripheral surface of the spacer main body part 14*a* and the inner wall surface 13*a* of the water jacket 13 in each inter-bore portion is exceptionally larger than the space α therebetween in any other portion.

Nevertheless, in each inter-bore portion in which the corresponding two cylinder sleeves 12, 12 are closer to each other, projection parts 14*i* are formed in an upper end of the spacer main body part 14*a*. A space α" between the tip end portion of each projection part 14*i* and the inner wall surface 13*a* of the water jacket 13 is set smaller than the space α.

As clear from FIGS. 1 to 3, 8 and 9, a cooling water supplying passage 11*b* extends from the timing train-side end surface of the cylinder block 11 toward the transmission. A cooling water supplying chamber 11*c* communicating with a downstream end of this cooling water supplying passage 11*b* faces the cooling water inlet port part 14*b* of the spacer 14 which is accommodated in the water jacket 13.

As clear from FIGS. 1 to 3 and FIG. 9, four communication holes 15*a* which are opened in the undersurface of a water jacket (not illustrated) formed in the cylinder head 15 face the upper portion of the cooling water outlet port part 14*c* of the spacer 14 accommodated in the water jacket 13. If the spacer main body part 14*a* would be extended to the position of the cooling water outlet part 14*c*, the position of the cooling water outlet port part 14*c* would roughly overlap the spacer main body part 14*a* thus extended.

As clear from FIGS. 1 to 3 and FIG. 10, the partition wall 14*d* interposed between the cooling water inlet port part 14*b* and the cooling water outlet port part 14*c* of the spacer 14 has a minimum microspace γ (refer to FIG. 10), which enables the spacer 14 to be assembled, between the inner wall surface 13*a* and the outer wall surface 13*b* of the water jacket 13. A microspace δ through which the cooling water can pass is formed between the lower end portion of the partition wall 14*d* and the outer wall surface 13*b* of the water jacket 13. Like the upper support legs 14*e*, 14*g* and the lower support legs 14*f*, 14*h*, the upper end portion and the lower end portion of the partition wall 14*d* has a function of positioning the spacer 14 inside the water jacket 13 in the up-and-down direction.

As clear from FIG. 2 and FIGS. 11A to 11C, a portion interposed between the upper support leg 14*e* and the lower support leg 14*f* in the timing train-side end portion of the spacer 14 (a portion corresponding to the cooling water outlet port part 14*c*) is a thickness part 14*m* which is as thick as the spacer main body part 14*a*. A slit 14*n* extending in the up-and-down direction is formed ranging from the lower end of the lower support leg 14*f* to the upper end of the thickness part 14*m*. A slit 22*a* of a rubber-made fixing member 22 having an H-shaped horizontal cross section is fitted in and thus attached to the slit 14*n*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*n* which is exposed to the lower support leg 14*f* aims at enhancing the assemblability by decreasing the resistance of pressure-insertion of the fixing member 22.

As clear from FIG. 2 and FIGS. 12A to 12C, a slit 14*o* extending in the up-and-down direction from the lower end of the lower support leg 14*h* to the lower end of the upper support leg 14*g* is formed in the transmission-side end portion of the spacer main body part 14*a*. Another rubber-made fixing member 22 having an H-shaped horizontal cross section is attached to the slit 14*o*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*o* which is exposed to the lower support leg 14*h* aims at enhancing the assemblability by decreasing the resistance of pressure-insertion of the fixing member 22.

The two fixing members 22, 22 both are arranged on the cylinder row line L1. Accordingly, the intake side portion and the exhaust side portion of the spacer 14 are basically symmetrical with respect to a line joining the two fixing members 22, 22 (in other words, the cylinder row line L1).

The slits 14*n*, 14*o* are opened downward. The fixing members 22, 22 are upward fitted in the slits 14*n*, 14*o*, respectively. For these reasons, when the spacer 14 to which the fixing members 22, 22 are attached is inserted inside the water jacket 13, the fixing members 22, 22 are unlikely to come off the slits 14*n*, 14*o* even if the fixing members 22, 22 are pushed upward by friction forces acting between the fixing members 22, 22 and the inner wall surface 13*a* of the water jacket 13.

Next, descriptions will be provided for the operation of the embodiment of the present invention having the foregoing configuration.

Before the cylinder head 15 is assembled to the deck surface 11*a* of the cylinder block 11, the water jacket 13 is opened to surround the outer peripheries of the cylinder bores 12*a*, 12*a*; 12*a*', 12*a*' of the four cylinder sleeves 12 exposed to the deck surface 11*a*, respectively. The spacer 14 is inserted inside the water jacket 13 from the opening. Thereafter, the cylinder head 15 is fastened to the cylinder block 11 with the gasket 16 overlapping the deck surface 11*a* of the cylinder block 11.

When this spacer 14 is assembled therein, the lower ends of the lower support legs 14*f*, 14*h* and the lower end of the partition wall 14*d* is in contact with the bottom portion of the water jacket 13, as well as the upper ends of the upper support legs 14*e*, 14*g* and the upper end of the partition wall 14*d* are in contact with the undersurface of the gasket 16. Thereby, the spacer 14 is positioned in the cylinder axis line L2 direction. At this time, the inner peripheral surface of the spacer main body part 14*a* of the spacer 14 is arranged close to the inner wall surface 13*a* of the water jacket 13. However, because the dimensional precision of the inner wall surface 13*a* of the water jacket 13 which has been subjected no process since casted is not high, the slight space α (refer to FIG. 6) is formed between the inner peripheral surface of the spacer main body part 14*a* and the inner wall surface 13*a* of the water jacket 13 for the purpose of preventing the assemblability from deteriorating due to friction of the spacer 14 with the inner wall surface 13*a* of the water jacket 13.

If the spacer 14 moves in the up-and-down direction inside the water jacket 13 due to vibrations and the like during the operation of the internal combustion engine, there is a possibility that the upper ends of the upper support legs 14*e*, 14*g* and the upper end of the partition wall 14*d* may damage the undersurface of the gasket 16. However, the two fixing members 22, 22 provided on the respective opposite ends in the cylinder row line L1 direction fix the spacer 14 to the water jacket 13 in order that the spacer 14 cannot move relative to the water jacket 13. This prevents haphazard movement of the spacer 14 from damaging the gasket 16.

At this time, not only can the spacer 14 be firmly fixed to the inside of the water jacket 13 because the fixing member 22, 22 are provided in the respective two highly-rigid end portions of the spacer 14 in the cylinder row line L1 direction, but also the influence of heat on the rubber-made fixing members 22, 22 attached to the respective opposite end portions of the cylinder block 11 in the cylinder row line L1 direction can be suppressed to a minimum because the opposite end portions of the cylinder block 11 are lower in temperature than the intake-side and exhaust-side side surfaces of the cylinder block 11.

In addition, because the fixing members 22, 22 are provided in the respective intermediate portions of the spacer 14 in the cylinder axis line L2 direction, in other words, in the range of the height of the spacer main body part 14*a*, it is possible to prevent the blockage of the flow of the cooling water in the upper cooling water passage 13*c* and in the lower cooling water passage 13*d* by the fixing members 22, 22, which would otherwise occur. In addition, because the timing train-side fixing member 22 of the spacer 14 is provided in the cooling water outlet port part 14*c*, the fixing member 22 does not affect the flow of the cooling water in the upper cooling water passage 13*c* and in the lower cooling water passage 13*d*. Furthermore, the flow speed of the cooling water decreases due to the U-turn of the cooling water in the transmission-side end portion of the water jacket 13. Accordingly, the influence of the fixing member 22 on the flow of the cooling water can be made smaller when the fixing member 22 is provided in the transmission-side end portion of the water jacket 13 than when the fixing member 22 is provided in the intake-side and exhaust-side side wall of the water jacket 13.

The timing train-side upper support leg 14*e* and lower support leg 14*f* of the spacer 14 are formed thinner in the radial direction than the thickness T1 of the spacer main body part 14*a*, and are arranged offset toward the outer wall surface 13*b* of the water jacket 13 inside the upper cooling water passage 13*c* and the lower cooling water passage 13*d*. In addition, the transmission-side upper support leg 14*g* and the lower support leg 14*h* of the spacer 14 are formed thinner in the radial direction than the thickness T1 of the spacer main body part 14*a*, and are arranged offset toward the inner wall surface 13*a* of the water jacket 13 inside the upper cooling water passage 13*c* and the lower cooling water passage 13*d*. Thereby, the influence of the upper support legs 14*e*, 14*g* and the lower support legs 14*f*, 14*h* on the flow of the cooling water in the upper cooling water passage 13*c* and in the lower cooling water passage 13*d* can be suppressed to a minimum. In addition, the upper support legs 14*e*, 14*g* and the lower support legs 14*f*, 14*h* are curved in the shape of an arc along the forms of the inner wall surface 13*a* and the outer wall surface 13*b* of the water jacket 13. Accordingly, the influence on the flow of the cooling water can be made much smaller.

Furthermore, out of the four cylinder bores 12*a*, 12*a*; 12*a*', 12*a*', their portions situated outermost in the cylinder row line L1 direction are less susceptible to heat from the other cylinder bores 12*a*', 12*a*'. For this reason, the temperature of such portions is relatively low. On the other hand, out of the four cylinder bores 12*a*, 12*a*; 12*a*', 12*a*', portions situated on the intake side and exhaust side of the cylinder row line L1 are susceptible to heat from their adjacent cylinder bores 12*a*, 12*a*; 12*a*', 12*a*'. For this reason, the temperature of such portions is relatively high. In the present embodiment, the upper support legs 14*e*, 14*g* and the lower support legs 14*f*, 14*h* are provided in the outermost positions in the cylinder row line L1 direction in which the temperature of the cylinder bores 12*a*, 12*a* is relatively low. For this reason, even if the flow of the cooling water in the water jacket 13 is more or less blocked by the upper support legs 14*e*, 14*g* and the lower support legs 14*f*, 14*h*, the influence can be suppressed to a minimum, and the temperatures of the respective cylinder bores 12*a*, 12*a*; 12*a*', 12*a*' can be made uniform.

In particular, the transmission-side upper support leg 14*g* and lower support leg 14*h* are arranged along the inner wall surface 13*a* of the water jacket 13 which faces the transmission-side lower-temperature portion of the corresponding cylinder bore 12*a*. For this reason, it is possible to make the cooling water less likely to come into contact with the inner wall surface 13*a* of the water jacket 13 by use of the upper support leg 14*g* and the lower support leg 14*h*, and to thermally insulate the cylinder bore 12*a*, whose temperature is relatively low. This makes it possible to make the temperatures of the respective cylinder bores 12*a*, 12*a*; 12*a*', 12*a*' much more uniform.

The fixing members 22, 22 are made of the rubber, as well as are fitted in and fixed to the slits 14*n*, 14*o* of the spacer 14. For this reason, the fixing members 22, 22 can be fixed to the spacer 14 without any specialized members, such as bolts. In addition, the positions at which the fixing members 22, 22 are provided are immediately above the lower support legs 14*f*, 14*h*. For this reason, it is possible to prevent the spacer 14 from deforming in a twisted manner when: the spacer 14 is downward pushed into the inside of the water jacket 13 while putting the fixing members 22, 22 in pressure contact with the inner wall surface 13*a* of the water jacket 13; the lower ends of the lower support legs 14*f*, 14*h* subsequently come in contact with the bottom portion of the water jacket 13; and the spacer 14 receives an upward force.

During the operation of the internal combustion engine, the cooling water supplied from a water pump (not illustrated) provided to the cylinder block 11 flows into the water jacket 13 from the cooling water supplying passage 11*b*, which is provided in the timing train-side end portion of the cylinder block 11, through the cooling water supplying chamber 11*c*. The spacer 14 is arranged inside the water jacket 13. The thickness T2 of the cooling water inlet port part 14*b* of the spacer 14, which faces the cooling water supplying chamber 11*c*, is thinner than the thickness T1 of the spacer main body part 14*a*. In addition, the cooling water inlet port part 14*b* is offset inward in the radial direction. For these reasons, the flow of the cooling water bifurcates into upper and lower streams along the radial-direction outer surface of the cooling water inlet port part 14*b*, and the cooling water thus smoothly flows into the upper cooling water passage 13*c* and the lower cooling water passage 13*d* of the water jacket 13.

The cooling water having flown into the upper cooling water passage 13*c* and the lower cooling water passage 13*d* of the water jacket 13 tends to bifurcate in the left and right directions. However, the flow of the cooling water is once blocked by the partition wall 14*d* existing on the left of the cooling water inlet port part 14*b*. For this reason, the direction of the flow of the cooling water is turned to the right. Subsequently, the cooling water flows counterclockwise in the upper cooling water passage 13*c* and the lower cooling water passage 13*d* in almost full length. Finally, the cooling water is discharged to the communication holes 15*a* in the cylinder head 15 from the cooling water outlet port part 14*c* which is situated on the opposite side of the partition wall 14*d* from the cooling water inlet port part 14*b*. While the cooling water is flowing in the water jacket 13, the cooling water flowing in the upper cooling water passage 13*c* and the cooling water flowing in the lower cooling water passage 13*d* hardly ever mingle with each other, because the upper cooling water passage 13*c* and the lower cooling water passage 13*d* are partitioned vertically by the spacer main body part 14*a* whose thickness T1 is slightly thinner than the width W of the water jacket 13.

When the cooling water having flown in the water jacket 13 is discharged to the water jacket (not illustrated) in the cylinder head 15 through the communication holes 15*a* opened to the undersurface of the cylinder head 15, the cooling water having flown in the lower cooling water passage 13*d* passes the cooling water outlet port part 14*c* of the spacer 14 from its lower part to its upper part, and thus joins the cooling water having flown in the upper cooling water passage 13*c*. Thereafter, the confluent cooling water flows into the communication holes 15*a* in the cylinder head 15.

At this time, not only can loss of the pressure of the cooling water upward passing the cooling water outlet port part 14*c* be suppressed to a minimum, but also the cooling effect can be secured even in a vicinity of the cooling water outlet port part 14*c*, in which the cooling effect decreases due to reduction in the flow rate of the cooling water, by causing as much cooling water as possible to intervene between the cooling water outlet port part 14*c* and the inner wall surface 13*a* of the water jacket 13. That is because: the cooling water outlet port part 14*c* is offset toward the outer wall surface 13*b* of the water jacket 13 with the thickness T3 of the cooling water outlet port part 14*c* being less than the thickness T1 of the spacer main body part 14*a* and with the outer peripheral surface being flush with the outer peripheral surface of the spacer main body part 14*a*.

In addition, the cooling water having come out of the downstream end of the upper cooling water passage 13*c* joins the cooling water having changed its flow direction upward after coming out of the downstream end of the lower cooling water passage 13*d*. Accordingly, the direction of the cooling water having come from the upper cooling water passage 13*c* can be changed upward by the cooling water having coming from the lower cooling water passage 13*d*, and the cooling water having come from the upper cooling water passage 13*c* can be made to flow into the communication holes 15*a* smoothly.

When the cooling water having flown in the upper cooling water passage 13*c* and the lower cooling water passage 13*d* is discharged from the communication holes 15*a* after changing its direction upward at the cooling water outlet port part 14*c*, there is a possibility that: swirls of the cooling water may occur; and the smooth direction change may be hindered. However, the flow of the cooling water into the communication holes 15*a* can be achieved by preventing the occurrence of the swirls, because a portion of the cooling water in the cooling water inlet port part 14*b* flows into the cooling water outlet port part 14*c* after passing the space δ (refer to FIG. 10) in the lower end portion of the partition wall 14*d*.

The inner peripheral surface of the spacer main body part 14*a* of the spacer 14 is close to the inner wall surface 13*a* at the intermediate portion of the water jacket 13 in the cylinder axis lines L2 direction. Accordingly, only a less amount of the cooling water comes into contact with the inner wall surface 13*a*, and the cooling is suppressed. As a result, the intermediate portions of the cylinder bores 12*a*, 12*a*; 12*a*', 12*a*' in the cylinder axis lines L2 direction, which are opposed to the spacer main body part 14*a*, become higher in temperature than the other portions thereof, and thermally expand to have larger clearances between the cylinder bores 12*a*, 12*a*; 12*a*', 12*a*' and their corresponding pistons 18, 18; 18', 18'. As a consequence, frictions between the pistons 18, 18; 18', 18' and the cylinder bores 12*a*, 12*a*; 12*a*', 12*a*' are reduced, particularly when large side thrusts are applied to the respective pistons 18, 18; 18', 18' during the compression process and the expansion process. Accordingly, it is possible to contribute to improving fuel efficiency of the internal combustion engine. Furthermore, because the intermediate portions of the cylinder bores 12*a*, 12*a*; 12*a*', 12*a*' in the cylinder axis lines L2 direction become higher in temperature than any other portions thereof, the temperature of the oil lubricating such portions rises, and the viscosity of the oil decreases. For this reason, the effect of friction reduction is enhanced more.

On the other hand, the upper portions and lower portions of the cylinder bores 12*a*, 12*a*; 12*a*', 12*a*' in the cylinder axis lines L2 direction are sufficiently cooled by the cooling water flowing in the upper cooling water passage 13*c* and the lower cooling water passage 13*d* above and under the spacer 14. Accordingly, it is possible to secure the cooling performances of the top parts 18*a* and the skirt parts 18*b* of the pistons 18, 18, 18', 18' slidably fitted in the cylinder bores 12*a*, 12*a*; 12*a*', 12*a*', and to prevent their overheat, although the temperatures of the top parts 18*a* and the skirt parts 18*b* would otherwise tend to rise. Moreover, not only does the upper portions of the cylinder bores 12*a*, 12*a*; 12*a*', 12*a*' directly receive heat of a combustion chamber, but also the upper portions thereof tend to raise their temperatures due to their reception of heat transmitted through the top rings 19, the second rings 20 and the oil rings 21 from the heated pistons 18, 18; 18', 18' which stay at the vicinities of their top dead centers for long time due to the change in their movement directions. However, because no spacer 14 is made to face the upper portions of the cylinder bores 12*a*, 12*a*; 12*a*', 12*a*', their cooling performances can be secured. In addition, the skirt parts 18*b* of the pistons 18, 18; 18', 18' are places which are most tightly put in sliding contact with the cylinder bores 12*a*, 12*a*; 12*a*', 12*a*', thereby causing friction therebetween. However, because the cylinder bores 12*a*, 12*a*; 12*a*', 12*a*' with which the skirt parts 18*b* are put in sliding contact are covered with the spacer 14 and the diameters of the cylinder bores 12*a*, 12*a*; 12*a*', 12*a*' is increased by thermal expansion, the friction can be reduced.

As indicated by the continuous line in FIG. 5, the up-and-down position of the spacer 14 is set in such a way that the top rings 19, the second rings 20 and the oil rings 21 are situated above the upper edge of the spacer main body part 14*a*, when the side thrusts of the respective pistons 18, 18, 18', 18' reach their maximum during the expansion process, in other words, when the friction between the pistons 18, 18, 18', 18' and the cylinder bores 12*a*, 12*a*; 12*a*', 12*a*' reaches its maximum. For this reason, the cooling performance of the pistons 18, 18; 18', 18' can be secured by: reducing the friction by increasing the inner diameters of the cylinder bores 12*a*, 12*a*; 12*a*', 12*a*' by use of the spacer 14; and concurrently making the heat of the top parts 18*a* of the heated pistons 18, 18, 18', 18', whose temperature tend to be higher, escape to the upper cooling water passage 13*c* of the water jacket 13 from the highly heat-conductive top rings 19, second rings 20 and oil rings 21 through the cylinder bores 12*a*, 12*a*; 12*a*', 12*a*'.

At this time, because the spacer main body part 14*a* of the spacer 14 is close to the inner wall surface 13*a* of the water jacket 13 with the minimum space α being interposed in between, it is possible to suppress the amount of cooling water intervening between the spacer main body part 14*a* and the inner wall surface 13*a* of the water jacket 13 to a minimum, and thus to thermally insulate the up-and-down-direction intermediate portions of the cylinder bores 12*a*, 12*a*; 12*a*', 12*a*' effectively, as well as to enlarge the diameters of the cylinder bores 12*a*, 12*a*; 12*a*', 12*a*'.

In addition, at the bottom dead centers indicated by the chain line in FIG. 5, the quantity of heat transmitted to the cylinder bores 12*a*, 12*a*; 12*a*', 12*a*' from the pistons 18, 18; 18', 18' through the top rings 19, the second rings 20 and the oil rings 21 is larger because the speeds at which the pistons 18, 18; 18', 18' move decrease. However, when the pistons 18, 18; 18', 18' reaches their bottom dead centers, the top rings 19, the second rings 20 and the oil rings 21 are situated below the lower edge of the spacer main body part 14*a*. For this reason, it is possible to make the heat of the pistons 18, 18; 18', 18' escape to the cylinder bores 12*a*, 12*a*; 12*a*', 12*a*' without being obstructed by the spacer 14, and to secure the cooling performances of the pistons 18, 18; 18', 18'.

Moreover, when the spacer 14 is assembled inside the water jacket 13, the space α between the inner peripheral surface of the spacer main body part 14*a* and the inner wall surface 13*a* of the water jacket 13 is set smaller than the space β between the outer peripheral surface of the spacer main body part 14*a* and the outer wall surface 13*b* of the water jacket 13. For this reason, the outer peripheral surface of the spacer main body part 14*a* is designed not to come in contact with the outer wall surface 13*b* of the water jacket 13, even though: the spacer 14 may deviate in the radial direction due to the assembling error and its deformation; and the inner peripheral surface of the spacer main body part 14*a* may come into contact with the inner wall surface 13*a* of the water jacket 13.

Because, as described above, the space is always secured between the outer peripheral surface of the spacer main body part 14*a* and the outer wall surface 13*b* of the water jacket 13, the following operation/working effects are exerted. To put it specifically, if unlike the present embodiment, the outer peripheral surface of the spacer main body part 14*a* would come in contact with the outer wall surface 13*b* of the water jacket 13, the hitting sounds of the pistons 18, 18; 18', 18' would be propagated via pathways from the cylinder bores 12*a*, 12*a*; 12*a*', 12*a*', the bottom portion of the water jacket 13, the lower support legs 14*f*, 14*h* of the spacer 14, the spacer main body part 14*a* to the outer wall surface 13*b* of the water jacket 13, and accordingly would constitute the cause of noises, because the lower support legs 14*f*, 14*h* of the spacer 14 are in contact with the bottom portion of the water jacket 13. Meanwhile, in the present embodiment, although hitting sounds of the pistons 18, 18; 18', 18' are propagated from the cylinder bores 12*a*, 12*a*; 12*a*', 12*a*' to the spacer main body part 14*a*, the hitting sounds are blocked in the spacer main body part 14*a* because the spacer main body part 14*a* does not abut on the outer wall surface 13*b* of the water jacket 13, thereby reducing noises.

If the spacer 14 deforms due to its swelling resulting from its contact with the cooling water and its thermal expansion, there is a possibility that the inner peripheral surface of the spacer 14 may be tightly fitted to the inner wall surface 13*a* of the water jacket 13. However, because the projection parts 14*i* provided on the spacer main body part 14*a* are opposed to the inner wall surface 13*a* of the water jacket 13 to come in contact with the inner wall surface 13*a* thereof, it is possible to prevent the inner peripheral surface of the spacer main body part 14*a* and the inner wall surface 13*a* of the water jacket 13 from coming into intimate contact with each other throughout their surfaces. Note that if the projection parts 14*i* come in contact with the inner wall surface 13*a* of the water jacket 13, there is a possibility that the hitting sounds may be propagated through the projection parts 14*i*. Basically, however, hitting sounds largely occur in the intake-side and exhaust-side portions of the outer peripheral surface of the pistons 18, 18, 18', 18' which are distant from the cylinder row line L1, and hitting sounds hardly ever occur in portions close to the cylinder row line L1 in which the projection parts 14*i* are provided. For this reason, the propagation of hitting sounds through the projection parts 14*i* substantially does not matter.

In addition, as shown in FIG. 2, the spacer 14 is stretched in the cylinder row line L1 direction by the reaction forces F1, F1, because the fixing members 22, 22 provided in the respective opposite end portions of the spacer 14 in the cylinder row line L1 direction elastically contact the inner wall surface 13*a* of the water jacket 13. As a result, the intake-side and exhaust-side side surfaces of the spacer main body part 14*a* deform by receiving loads F2, F2 working in a direction in which the intake-side and exhaust-side side surfaces thereof come closer to each other. For this reason, the inner peripheral surface of the spacer main body part 14*a* comes closer to the inner wall surface 13*a* of the water jacket 13, and the space α between the inner peripheral surface of the spacer main body part 14*a* and the inner wall surface 13*a* of the water jacket 13 decreases accordingly. Thereby, the amount of cooling water intervening between the spacer main body part 14*a* and the inner wall surface 13*a* of the water jacket 13 can be reduced more, and the up-and-down-direction intermediate portions of the cylinder bores 12*a*, 12*a*; 12*a*', 12*a*' thus can be thermally insulated more effectively, as well as the diameters thereof can be enlarged.

At this time, the two fixing members 22, 22 both are arranged on the cylinder row line L1, and the intake-side portion and exhaust-side portion of the spacer 14 are basically symmetrical with respect to the cylinder row line L1. For this reason, the loads F2, F2 which cause the intake-side and exhaust-side side surfaces of the spacer main body part 14*a* to come closer to each other can be made uniform, and the amount of deformation of the intake-side portion of the spacer 14 and the amount of deformation of the exhaust-side portion of the spacer 14 can be made uniform.

Furthermore, because the fixing members 22, 22 are attached to the spacer main body part 14*a* in a way not to cut into the upper cooling water passage 13*c* or the lower cooling water passage 13*d*, the fixing members 22, 22 do not obstruct the flow of the cooling water. In addition, because the fixing member 22, 22 are attached to the spacer main body part 14*a* in a way not to interfere with the upper support legs 14*e*, 14*g* or the lower support legs 14*f*, 14*h* of the spacer 14, the spacer main body part 14*a* can be efficiently deformed with the resilient forces of the fixing members 22, 22.

Meanwhile, each end-portion cylinder bore 12*a* is opposed to one corresponding intermediate cylinder bore 12*a*' alone, while each intermediate bore 12*a*' is opposed to one corresponding end-portion cylinder bore 12*a* and the other intermediate cylinder bore 12*a*'. For this reason, the intermediate cylinder bores 12*a*' tend to be higher in temperature than the end-portion cylinder bores 12*a*.

Nevertheless, the present embodiment makes the effect of cooling the intermediate cylinder bores 12*a*', 12*a*' higher than the effect of cooling the end-portion cylinder bores 12*a*, 12*a* because: the height H of the spacer main body part 14*a* of the spacer 14 is lower by the step t in its portions facing the intermediate cylinder bores 12*a*', 12*a*' than in its portions facing the end-portion cylinder bores 12*a*, 12*a*; and accordingly, the height of the upper cooling water passage 13*c* facing the intermediate cylinder bores 12*a*', 12*a*' is higher. This enables the spacer 14 to effectively exert the effect of friction reduction by: strongly cooling the intermediate cylinder bores 12*a*', 12*a*' which tend to be higher in temperature than the end-portion cylinder bores 12*a*, 12*a*; and thus making all the temperatures of the respective cylinder bores 12*a*, 12*a*; 12*a*', 12*a*' uniform.

Figure 13:
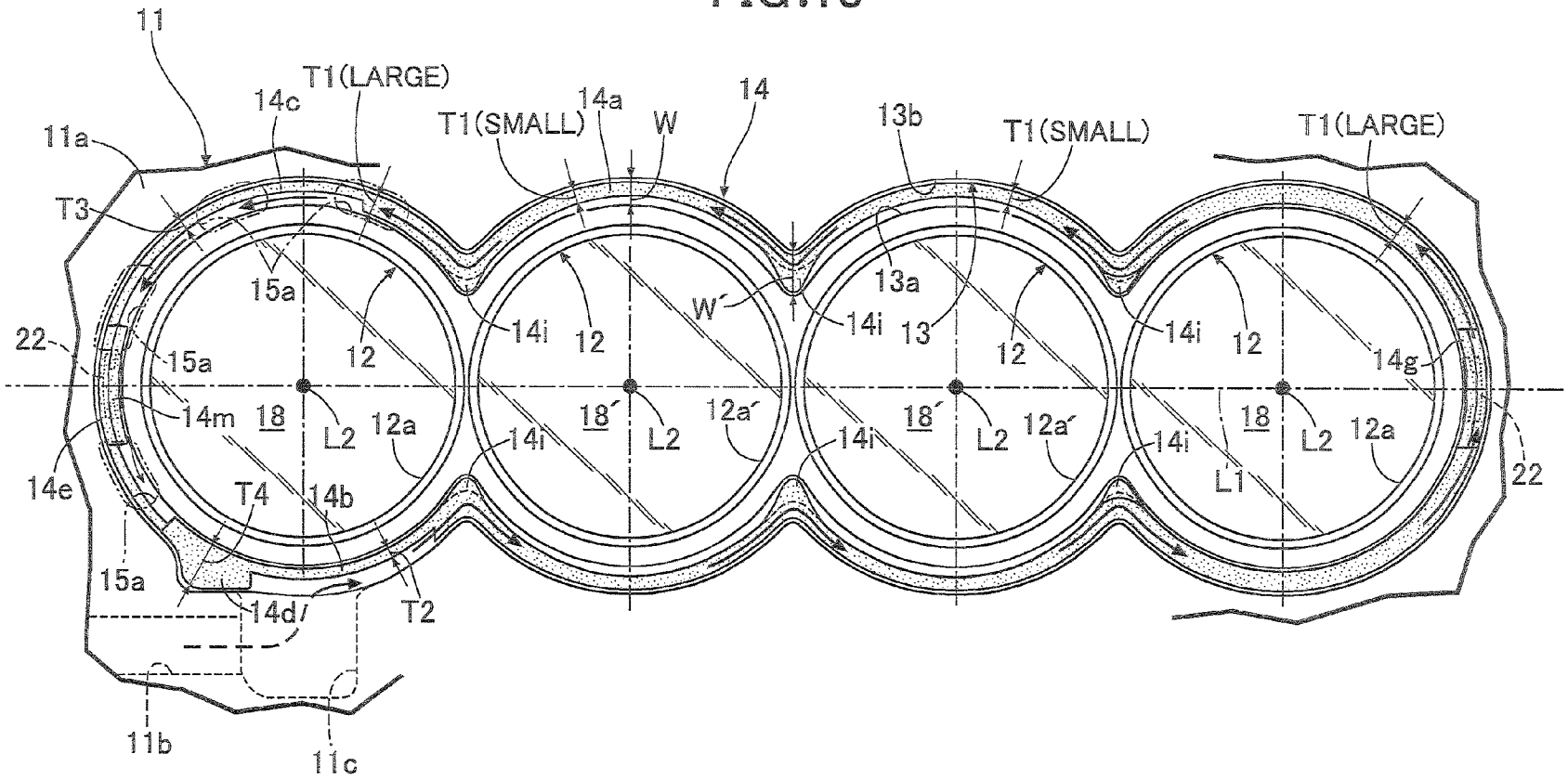
FIG. 13 is a view corresponding to the above-described FIG. 3 (Second embodiment)

Next, descriptions will be provided for a second embodiment of the present invention on the basis of FIG. 13.

In the first embodiment, the height of the spacer main body part 14*a* is set higher in its portions facing the end-portion cylinder bores 12*a*, 12*a*, and is set lower in its portions facing the intermediate cylinder bores 12*a*', 12*a*'. In the second embodiment, the thickness T1 of the spacer main body part 14*a* is set thicker in its portions facing the end-portion cylinder bores 12*a*, 12*a*, and is set thinner in its portions facing the intermediate cylinder bores 12*a*', 12*a*'.

As a result, the space α (refer to FIG. 6) formed between the inner peripheral surface of the spacer main body part 14*a* and the inner wall surface 13*a* of the water jacket 13 is larger in its portions facing the intermediate cylinder bores 12*a*', 12*a*'. The cross-sectional area of the passage of the cooling water in the space α is increased accordingly, and the cooling performances of the intermediate cylinder bores 12*a*', 12*a*' are thus enhanced. Hence, all the temperature of the respective cylinder bores 12*a*, 12*a*; 12*a*', 12*a*' can be made uniform as in the first embodiment. In addition, because the spacer 14 made of a synthetic resin has a heat conductivity lower than that of the cooling water, the heat of the intermediate cylinder bores 12*a*', 12*a*' is easy to escape toward the outer wall surfaces of the cylinder block 11 through the spacer main body part 14*a* by making the spacer main body part 14*a* thinner, and the cooling performances of the intermediate cylinder bores 12*a*', 12*a*' are enhanced more effectively. Furthermore, because the thickness T1 of the spacer main body part 14*a* is made thinner in its portions facing the intermediate cylinder bores 12*a*', 12*a*' by moving the inner peripheral surface of the spacer main body part 14*a* outward in the radial direction, it is possible to effectively increase the cross-sectional area of the passage of the cooling water in the space α between the inner peripheral surface of the spacer main body part 14*a* and the inner wall surface 13*a* of the water jacket 13.

Moreover, the space α between the inner peripheral surface of the spacer main body part 14*a* and the inner wall surface 13*a* of the water jacket 13 may be increased by: making the thickness T1 of the spacer main body part 14*a* uniform in all its portions facing the cylinder bores 12*a*, 12*a*; 12*a*', 12*a*'; and moving the spacer main body part 14*a* outward in the radial direction in its portions facing the intermediate cylinder bores 12*a*', 12*a*'. Also in this way, the cooling performances of the intermediate cylinder bores 12*a*', 12*a*' can be enhanced by making more cooling water flow along the inner wall surface 13*a* of the water jacket 13, which faces the intermediate cylinder bores 12*a*', 12*a*'.

Figure 14:
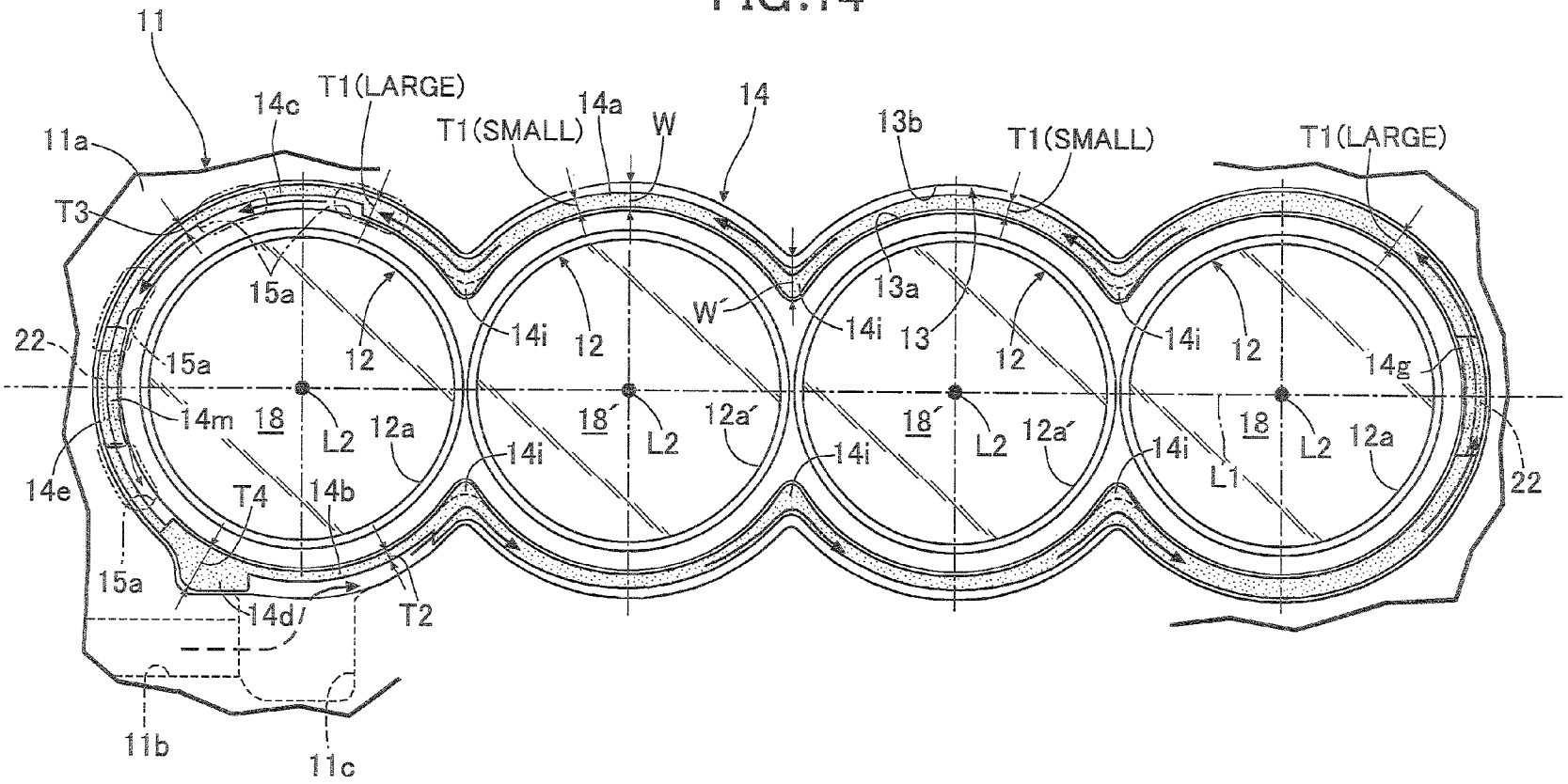
FIG. 14 is a view corresponding to the above-described FIG. 3 (Third embodiment)

Next, descriptions will be provided for a third embodiment of the present invention on the basis of FIG. 14.

The third embodiment is a modification of the second embodiment. In the second embodiment, in the spacer main body part 14*a*'s portions facing the intermediate cylinder bores 12*a*', 12*a*', the thickness T1 of the spacer main body part 14*a* is made thinner by moving the position of the inner peripheral surface of the spacer main body part 14*a* outward in the radial direction. In the third embodiment, in the spacer main body part 14*a*'s portions facing the intermediate cylinder bores 12*a*', 12*a*', the thickness T1 of the spacer main body part 14*a* is made thinner by moving the position of the outer peripheral surface of the spacer main body part 14*a* inward in the radial direction.

The third embodiment does not change the size of the space α (refer to FIG. 6) formed between the inner peripheral surface of the spacer main body part 14*a* and the inner wall surface 13*a* of the water jacket 13, but makes the spacer main body part 14*a* thinner in its portions facing the intermediate cylinder bores 12*a*', 12*a*'. For this reason, the third embodiment makes it easier for the heat of the intermediate cylinder bores 12*a*', 12*a*' to escape to the radial-direction outer space β (refer to FIG. 6) of the water jacket 13 and the outer wall surfaces of the cylinder block 11, thereby capable of enhancing the cooling performances of the intermediate cylinder bores 12*a*', 12*a*'.

Figure 15:
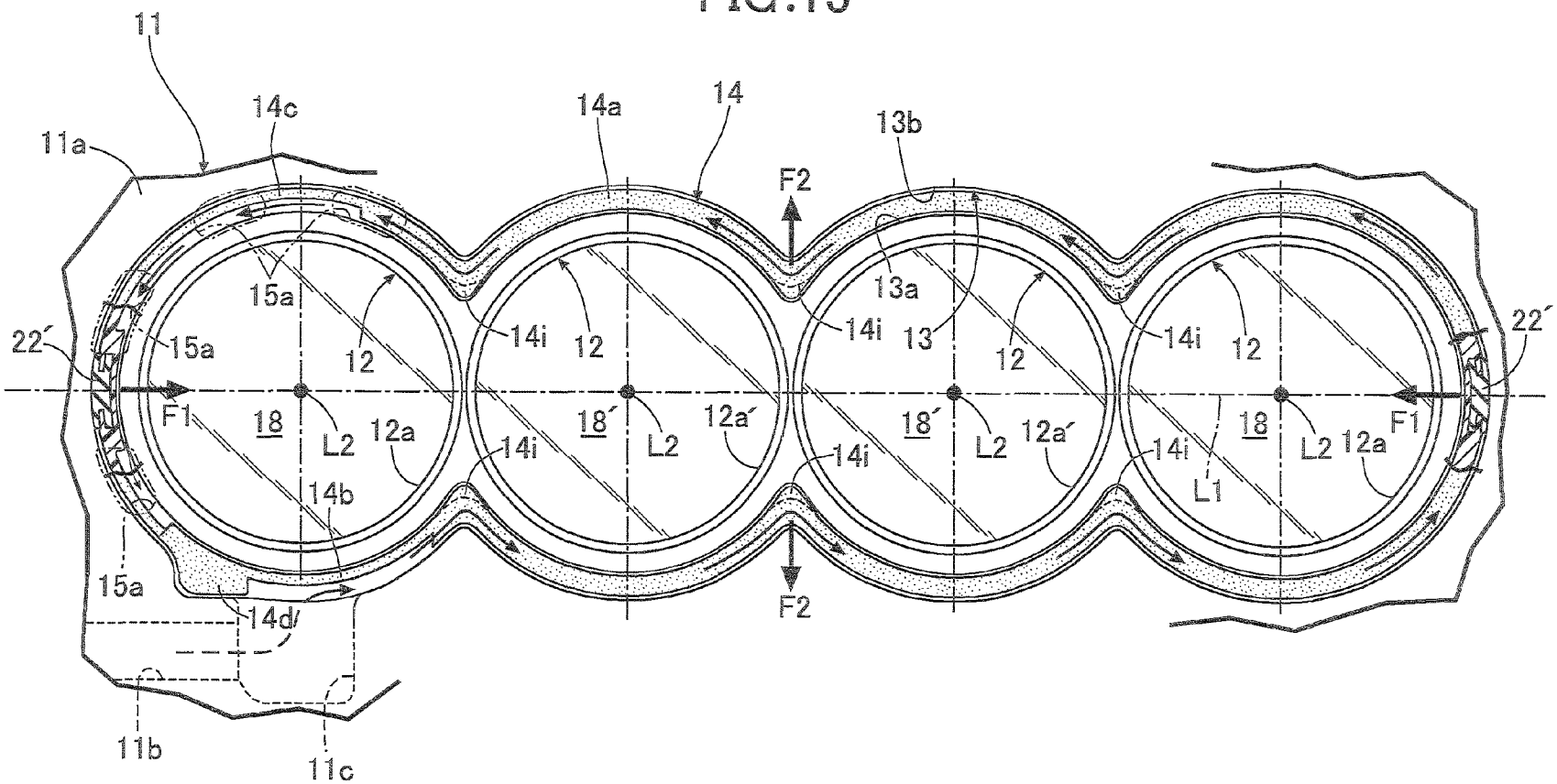
FIG. 15 is a view corresponding to the above-described FIG. 3 (Fourth embodiment).

Next, descriptions will be provided for a fourth embodiment of the present invention on the basis of FIG. 15.

In the first embodiment, the fixing members 22, 22 provided in the respective opposite end portions of the spacer 14 in the cylinder row line L1 direction elastically abut on the inner wall surface 13*a* of the water jacket 13. In the fourth embodiment, fixing members 22', 22' are attached to the respective opposite end portions of the spacer 14 in such a way that the inside and outside of each fixing member 22', 22' are reversed in the radial direction, and elastically abut on the outer wall surface 13*b* of the water jacket 13. The structure of the fixing members 22', 22' according to the fourth embodiment is substantially the same as that of the fixing members 22, 22 according to the first embodiment.

Thereby, the opposite end portions of the spacer 14 in the cylinder row line L1 direction are biased by loads F1', F1' produced by resilient forces of the fixing members 22', 22' in a direction in which the opposite end portions thereof come closer to each other. For this reason, the intake-side and exhaust-side side surfaces of the spacer main body part 14*a* receive loads F2', F2' working in a direction in which the side surfaces thereof are made to go away from each other, and deforms outward in the radial direction. As a result, the inner peripheral surface of the spacer main body part 14*a* goes away from the inner wall surface 13*a* of the water jacket 13, and the space α between the inner peripheral surface of the spacer main body part 14*a* and the inner wall surface 13*a* of the water jacket 13 increases accordingly. Thereby, the cross-sectional area of the passage of the cooling water in the space α increases, and the cooling performances of the intermediate cylinder bores 12*a*', 12*a*' are enhanced. Hence, all the temperatures of the cylinder bores 12*a*, 12*a*; 12*a*', 12*a*' can be made uniform as in the second embodiment.

Although the foregoing descriptions have been provided for the embodiments of the present invention, various design changes may be applied to the present invention within the scope not departing from the gist of the present invention.

For example, the internal combustion engine with four cylinders mounted in a straight line has been shown as an example of the embodiments. However, the present invention can be applied to an internal combustion engine of any arbitrary mode having three or more cylinders, in which three or more cylinder bores 12*a*, 12*a*' are arranged one after another.

Furthermore, in the first embodiment, the height of the upper edge of the spacer main body part 14*a* is made lower in its portions facing the intermediate cylinder bores 12*a*'. However, the height of the lower edge of the spacer main body part 14*a* may be made higher in its portions facing the intermediate cylinder bores 12*a*'. Otherwise, the two modes may be used in combination.

Moreover, the present invention can be applied to an internal combustion engine in which: the cooling water supplied from one end side of the cylinder row line L1 is bifurcated into two streams flowing along the intake-side side surface and the exhaust-side side surface, respectively; the two streams are made confluent in the other end side of the cylinder row line L1; and the confluent cooling water is discharged therefrom.

What is claimed is:

1. A cooling structure for an internal combustion engine in which: a spacer is fitted inside a water jacket which is formed to surround peripheries of three or more cylinder bores arranged one after another on a cylinder row line of a cylinder block of the internal combustion engine; and a cooling condition of the cylinder bores is controlled by regulating a flow of cooling water in the water jacket by use of the spacer, wherein the cylinder bores comprise end-portion cylinder bores situated respectively in opposite end portions in a direction of the cylinder row line, and one or more intermediate cylinder bores other than the end-portion cylinder bores, and the spacer comprises a spacer main body part which has a height in an up-and-down direction in both side portions facing the intermediate cylinder bores that is lower than a height in portions facing the end-portion cylinder bores, thereby providing cooling performances for the intermediate cylinder bores that are higher than those for the end-portion cylinder bores.

2. The cooling structure for an internal combustion engine according to claim 1, wherein the spacer main body part defines an upper cooling water passage for an upper side and a lower cooling water passage for a lower side inside the water jacket, and the spacer main body part has an upper face facing the upper cooling water passage and a lower face facing the lower cooling water passage, such that a portion of the upper face positioned in both of said side portions facing the intermediate cylinder bores is formed lower than another portion of the upper face positioned in said portions facing the end-portion cylinder bores, while the lower face is formed flush between portions thereof positioned in said side portions facing the intermediate cylinder bores and in said portions facing the end-portion cylinder bores.

3. A cooling system for an internal combustion engine in which: a spacer is fitted inside a water jacket which is formed to surround peripheries of three or more cylinder bores arranged one after another on a cylinder row line of a cylinder block of the internal combustion engine; and a cooling condition of the cylinder bores is controlled by regulating a flow of cooling water in the water jacket by use of the spacer, wherein the cylinder bores comprise end-portion cylinder bores situated respectively in opposite end portions in a direction of the cylinder row line, and one or more intermediate cylinder bores other than the end-portion cylinder bores, and the spacer is configured so that cooling performances for the intermediate cylinder bores are higher than those for the end-portion cylinder bores, wherein the spacer comprises a spacer main body part for regulating the flow of the cooling water in the water jacket, and the spacer main body part has a smaller thickness in a radial direction in portions facing the intermediate cylinder bores than in portions facing the end-portion cylinder bores.

4. A cooling system for an internal combustion engine in which: a spacer is fitted inside a water jacket which is formed to surround peripheries of three or more cylinder bores arranged one after another on a cylinder row line of a cylinder block of the internal combustion engine; and a cooling condition of the cylinder bores is controlled by regulating a flow of cooling water in the water jacket by use of the spacer, wherein the cylinder bores comprise end-portion cylinder bores situated respectively in opposite end portions in a direction of the cylinder row line, and one or more intermediate cylinder bores other than the end-portion cylinder bores, and the spacer is configured so that cooling performances for the intermediate cylinder bores are higher than those for the end-portion cylinder bores, wherein the spacer comprises a spacer main body part for regulating the flow of the cooling water in the water jacket, and a passage of the cooling water between an inner peripheral surface of the spacer main body part and an inner wall surface of the water jacket has a larger cross-sectional area in portions facing the intermediate cylinder bores than in portions facing the end-portion cylinder bores.

5. The cooling structure for an internal combustion engine according to claim 4, wherein biasing means for biasing the opposite end portions of the spacer main body part in the cylinder row line direction toward the inner wall surface of the water jacket are provided between the opposite end portions of the spacer main body part in the cylinder row line direction and an outer wall surface of the water jacket.

6. The cooling structure for an internal combustion engine according to claim 5, wherein the biasing means are fixing members for fixing the spacer inside the water jacket.

* * * * *